US010815727B2

(12) United States Patent
Dubina et al.

(10) Patent No.: US 10,815,727 B2
(45) Date of Patent: Oct. 27, 2020

(54) CORDLESS COVERING WITH TILTABLE VANES

(71) Applicant: Hunter Douglas Industries Switzerland GmbH, Lucerne (CH)

(72) Inventors: Mary Jo Dubina, Atlanta, GA (US); Gerald N. Hunsburger, Cumming, GA (US); John Anthony Wargo, Atlanta, GA (US); Josh Deward, Roswell, GA (US)

(73) Assignee: Hunter Douglas Industries Switzerland GmbH, Lucerne (CH)

( * ) Notice: Subject to any disclaimer, the term of this patent is extended or adjusted under 35 U.S.C. 154(b) by 159 days.

(21) Appl. No.: 15/837,568

(22) Filed: Dec. 11, 2017

(65) Prior Publication Data

US 2018/0179812 A1 Jun. 28, 2018

Related U.S. Application Data

(60) Provisional application No. 62/437,818, filed on Dec. 22, 2016.

(51) Int. Cl.

| | |
|---|---|
| ***E06B 9/42*** | (2006.01) |
| ***E06B 9/322*** | (2006.01) |
| ***E06B 9/308*** | (2006.01) |
| ***E06B 9/264*** | (2006.01) |
| ***E06B 9/34*** | (2006.01) |
| *E06B 9/60* | (2006.01) |
| *E06B 9/24* | (2006.01) |

(52) U.S. Cl.

CPC ..... *E06B 9/42* (2013.01); *E06B 9/264* (2013.01); *E06B 9/308* (2013.01); *E06B 9/322* (2013.01); *E06B 9/34* (2013.01); *E06B 9/60* (2013.01); *E06B 2009/2435* (2013.01); *E06B 2009/2458* (2013.01); *E06B 2009/3222* (2013.01)

(58) Field of Classification Search

CPC ... E06B 9/42; E06B 9/34; E06B 9/264; E06B 2009/2458; E06B 2009/2435; E06B 9/60; E06B 9/322; E06B 9/308; E06B 2009/3222

USPC ... 160/32, 61, 107, 113, 129, 130, 131, 162, 160/164, 174 R, 178.3

See application file for complete search history.

(56) References Cited

U.S. PATENT DOCUMENTS

2005/0045279 A1* 3/2005 Zhang ..... E06B 9/264 160/84.05
2014/0216666 A1* 8/2014 Smith ..... E06B 9/44 160/84.04

FOREIGN PATENT DOCUMENTS

WO WO 2014/143057 9/2014

* cited by examiner

*Primary Examiner* — Justin V Lewis
(74) *Attorney, Agent, or Firm* — Dority & Manning, P.A.

(57) ABSTRACT

In one aspect, a cordless covering may include a roller and a shade panel configured to be wound around and unwound from the roller to move the shade panel between an extended position and a retracted position. The shade panel may include a front panel, a back panel, and a plurality of vanes extending between the front and back panels. The covering may also include a roller shaft extending through the roller and a tilt adjustment mechanism coupled to the roller shaft. The tilt adjustment mechanism may be configured to rotate the roller shaft to adjust a tilt angle of the vanes between an opened position and a closed position.

20 Claims, 23 Drawing Sheets

CORDLESS COVERING WITH TILTABLE VANES

CROSS-REFERENCE TO RELATED APPLICATIONS

This application is based upon and claims the right of priority to U.S. Provisional Patent Application No. 62/437,818, filed on Dec. 22, 2016, the disclosure of which is hereby incorporated by reference herein in its entirety for all purposes.

FIELD OF THE INVENTION

The present subject matter relates generally to coverings for architectural structures and, more particularly, to a cordless covering with tiltable vanes that allow the amount of light passing through the covering to be adjusted quickly and easily.

BACKGROUND OF THE INVENTION

Cordless roller shades are known that include a roller and a shade panel configured to be wound around and unwound from the roller to move the shade panel relative to an architectural structure, such as a window, between a raised or retracted position and a lowered or extended position. In some instances, the shade panel includes a front fabric panel, a rear fabric panel, and a plurality of vanes extending between the front and back panels. This configuration is often used with front and back panels formed from a sheer fabric, with the vanes formed from a light blocking or opaque material, and may be referred to as "sheer shadings."

With sheer shadings and other roller shades including vanes extending between front and back panels, it is often desirable to allow the user of the shade to adjust the tilt angle of the vanes, thereby providing a means for effectively controlling the amount of light that passes through the shade. In this regard, coverings have been designed in the past that include tiltable vanes. However, while such designs significantly improve the functionality of conventional roller shades, further enhancements are needed to improve the usability of such shades from a consumer perspective and/or to provide improved systems and/or mechanisms for adjusting the tilt angle of the vanes.

Accordingly, an improved cordless covering with tiltable vanes to allow the amount of light passing through the covering to be adjusted quickly and easily would be welcomed in the technology.

BRIEF DESCRIPTION OF THE INVENTION

Aspects and advantages of the present subject matter will be set forth in part in the following description, or may be obvious from the description, or may be learned through practice of the present subject matter.

In various aspects, the present subject matter is directed to a cordless covering with tiltable vanes. In several embodiments, the covering may include a roller and a shade panel configured to be wound around and unwound from the roller to move the shade panel between an extended position and a retracted position. The shade panel may include a front panel, a back panel, and a plurality of vanes extending between the front and back panels. In addition, the covering may include a tilt adjustment mechanism configured to adjust a tilt angle of the vanes between an opened position and a closed position.

In several embodiments, the tilt adjustment mechanism may include a tilt drive shaft configured to be coupled to a roller shaft extending through the roller of the covering and a tilt drive actuator coupled to the tilt drive shaft. In such embodiments, actuation of the tilt drive actuator may result in rotation of the tilt drive shaft, which may, in turn, rotate the roller shaft in a manner that adjusts the tilt angle of the vanes between their opened and closed positions. For instance, the tilt drive actuator may be linearly actuated and/or rotationally actuated to rotationally drive the tilt drive shaft.

Additionally, in another aspect, the present subject matter is directed to a bottom rail configured for use with a covering for an architectural opening, such as a roller shade or any other suitable window covering. In several embodiments, the bottom rail may define an "S-shaped" or wavy profile along the cross-wise direction of the covering, which may provide the bottom rail with a unique aesthetic appearance. Additionally, the "S-shaped" profile of the bottom rail may provide one or more functional advantages for the associated covering, such as by allowing the bottom rail to at least partially nest with a roller of the covering.

These and other features, aspects and advantages of the present subject matter will become better understood with reference to the following description and appended claims. The accompanying drawings, which are incorporated in and constitute a part of this specification, illustrate embodiments of the present subject matter and, together with the description, serve to explain the principles of the present subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE INVENTION

Figure 1:
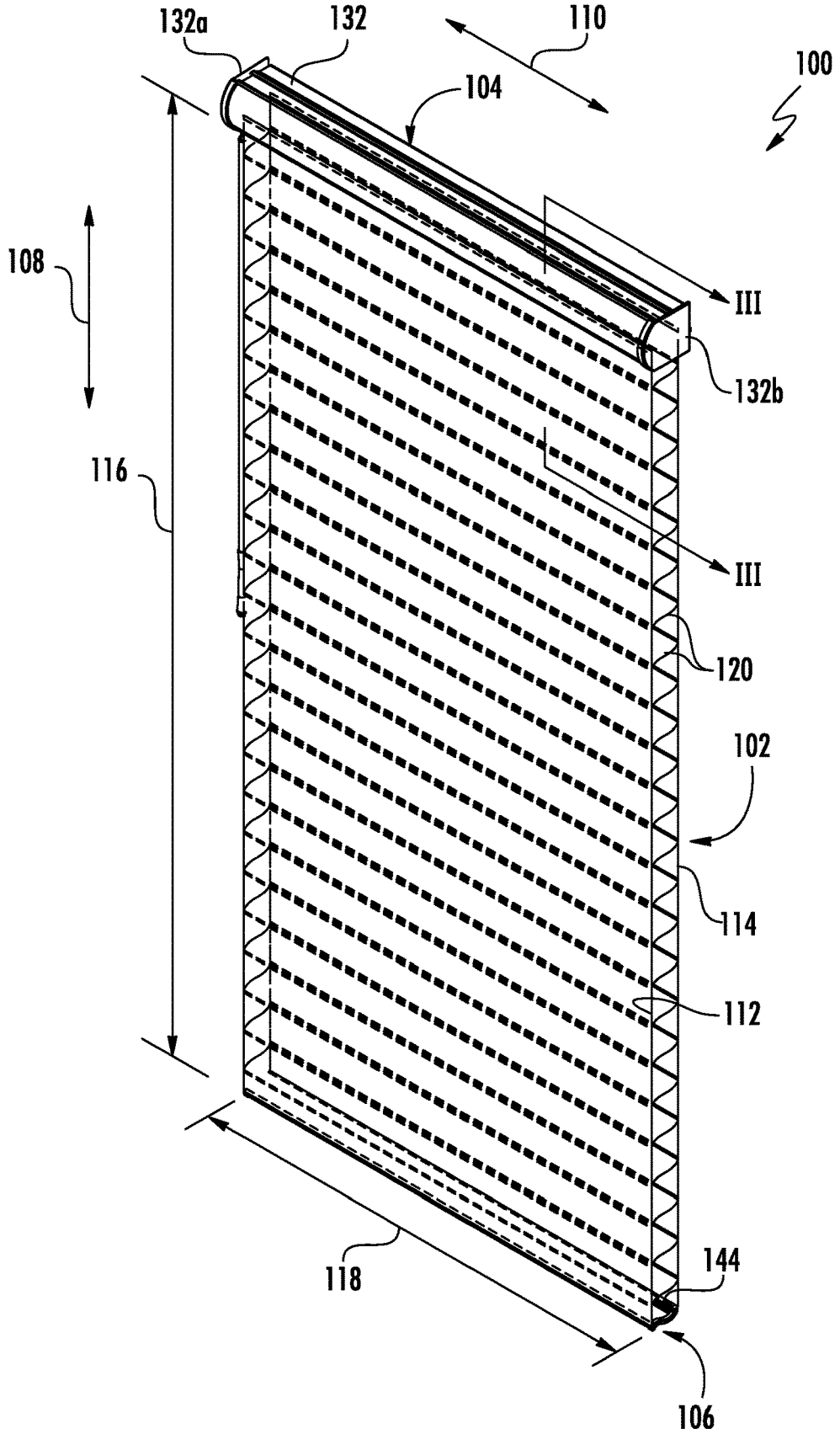
FIG. 1 illustrates a perspective view of one embodiment of a cordless covering in accordance with aspects of the present subject matter.

Reference now will be made in detail to embodiments of the present subject matter, one or more examples of which are illustrated in the drawings. Each example is provided by way of explanation without intent to limit the broad concepts of the present subject matter. In fact, it will be apparent to those skilled in the art that various modifications and variations can be made in the present subject matter without departing from the scope or spirit of the present subject matter. For instance, features illustrated or described as part of one embodiment can be used with another embodiment to yield a still further embodiment. Thus, it is intended that the present subject matter covers such modifications and variations as come within the scope of the appended claims and their equivalents.

In general, the present subject matter is directed to a cordless covering with tiltable vanes. Specifically, in several embodiments, the cordless covering may include a shade panel configured to be wound around and unwound from a roller to allow the shade panel to be moved between retracted and extended positions. As will be described below, the shade panel may include a front panel, a back panel, and a plurality of vertically spaced vanes extending between the front and back panels. Additionally, in accordance with various aspects of the present subject matter, the disclosed covering may include a tilt adjustment mechanism configured to allow a user to adjust the tilt angle of the vanes between opened and closed positions. For example, in several embodiments, when the shade panel is lowered to its extended position, the tilt adjustment mechanism may be configured to shift the front and back panels relative to each other in a manner that results in the vanes being tilted between their opened and closed positions, such as by rotating the roller to which the panels are coupled. As such, a user may quickly and easily adjust the amount of light passing through the covering by manipulating the tilt adjustment mechanism via a suitable user control device (e.g., a tilt wand or other suitable control device).

As will be described below, the type of control action that is utilized to manipulate the tilt adjustment mechanism may vary depending on the configuration of the tilt adjustment mechanism. For example, in one embodiment, the tilt adjustment mechanism may incorporate a worm drive assembly in which rotation of the worm gear results in corresponding rotation of the roller to allow for adjustment of the tilt angle of the vanes. In such an embodiment, a user may rotate the tilt wand or other suitable user control device to manually adjust the tilt angle of the vanes. In another embodiment, the tilt adjustment mechanism may incorporate a rack and pinion assembly in which linear actuation of the rack results in corresponding rotation of the roller to allow for adjustment of the tilt angle of the vanes. In such an embodiment, a user may simply push or pull the tilt wand or other suitable user control device relative to the tilt adjustment mechanism to manually adjust the tilt angle of the vanes.

Additionally, the present subject matter is also directed to a new and improved bottom rail design. Specifically, in accordance with aspects of the present subject matter, the disclosed bottom rail may define an "S-shaped" profile. The "S-shaped" profile may generally provide the bottom rail with a very unique aesthetic appearance. For example, in the context of the disclosed covering, the appearance of the "S-shaped" bottom rail may be complementary to the shade panel, particularly when the vanes are designed to form a similar "S-shaped" profile between the front and back panels. However, the disclosed bottom rail may also be used with any other suitable covering for an architectural feature. Moreover, the "S-shaped" profile may also provide particular functional advantages for a given covering. For instance, when the shade panel of a roller shade is moved to its retracted or raised position, the curvature of the bottom rail may be selected to allow a portion of the rail to fit snugly against and/or extend circumferentially around a portion of the wrapped roller, thereby providing a more compact assembly for the roller shade when in the retracted position.

Figure 2:
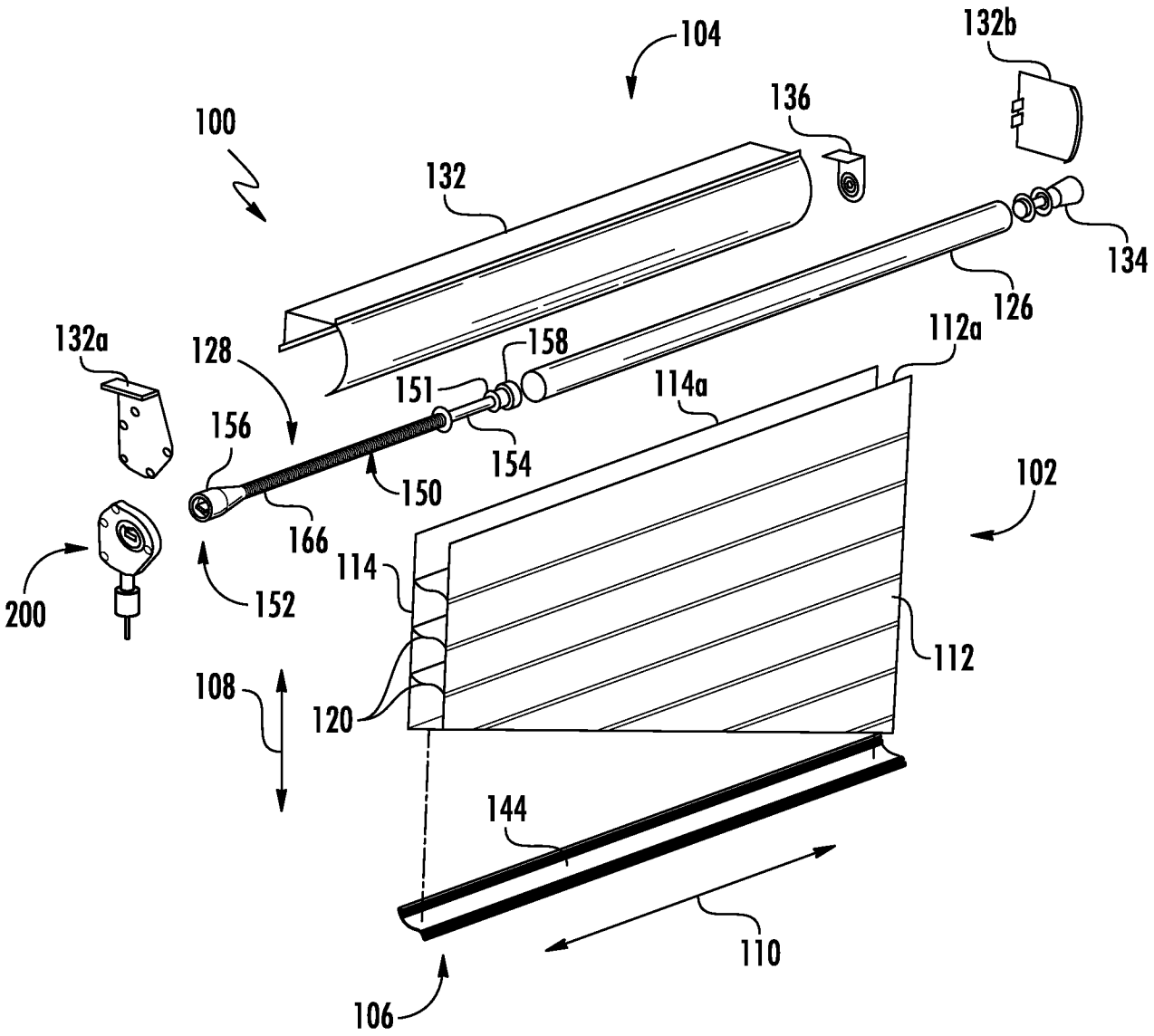
FIG. 2 illustrates a partial, perspective view of the covering shown in FIG. 1, particularly illustrating components of a head rail or roller assembly of the covering exploded out for purposes of illustration and discussion.
Figure 3:
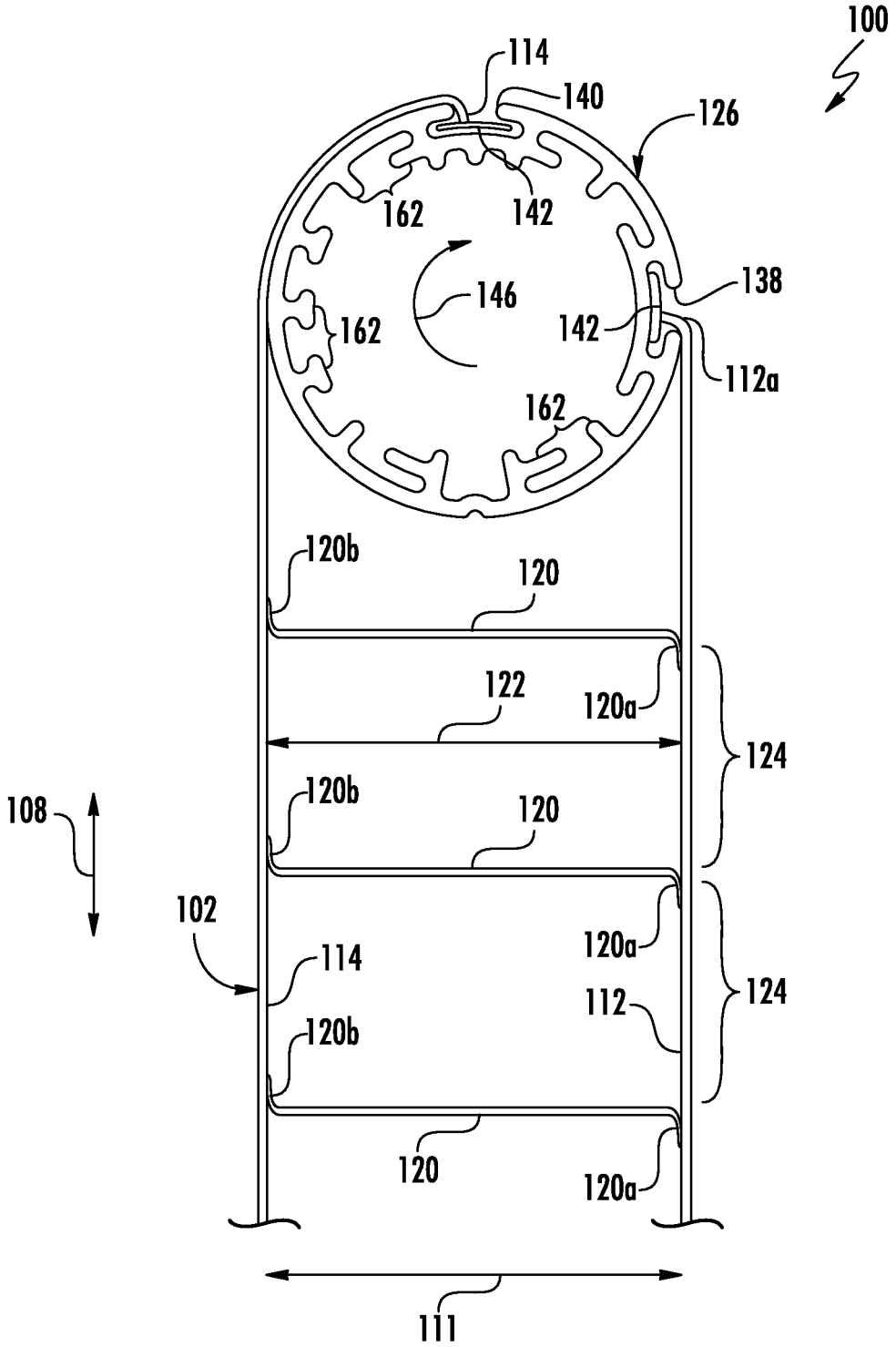
FIG. 3 illustrates a cross-sectional view of the covering shown in FIG. 1 taken about line III-III, particularly illustrating the vanes of the covering in an opened position.

Referring now to the drawings, FIGS. 1-3 illustrate several views of one embodiment of a cordless covering 100 configured for use relative to an architectural structure in accordance with aspects of the present subject matter. Specifically, FIG. 1 illustrates an assembled, perspective view of the covering 100. FIG. 2 illustrates a partial, perspective view of the covering 100 shown in FIG. 1, particularly illustrating various components of a head rail or roller assembly 104 of the covering 100 exploded out for purposes of illustration and discussion. Additionally, FIG. 3 illustrates a cross-sectional view of a portion of the covering 100 shown in FIG. 1 taken about line III-III. In the illustrated embodiment, the covering 100 is configured as a roller shade or sheer shading. However, in other embodiments, covering 100 may have any other suitable configuration for covering an adjacent architectural structural.

Figure 20:
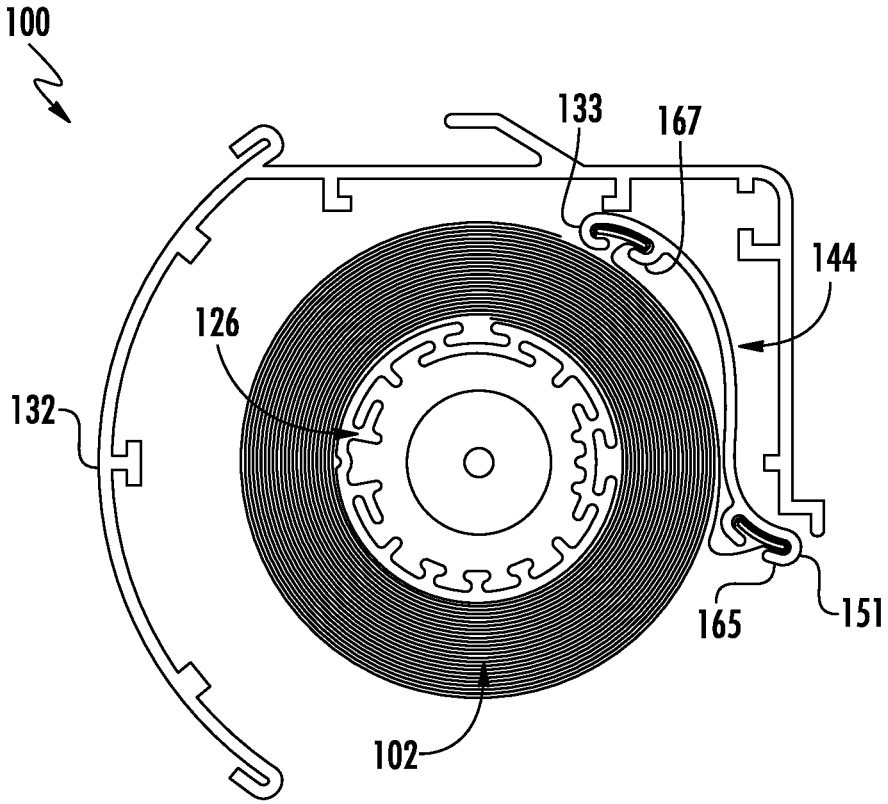
FIG. 20 illustrates a cross-sectional view of the covering shown in FIG. 1 with the shade panel being raised to its retracted position to show an example of the relative positioning between the bottom rail and the wrapped roller.

As shown in FIGS. 1 and 2, the covering 100 may include a shade panel 102 configured to extend vertically between a head rail or roller assembly 104 and a bottom rail assembly 106. The shade panel 102 may generally be configured to be moved vertically relative to the roller assembly 104 between a fully lowered or extended position (e.g., as shown in FIG. 1) and a fully raised or retracted position (e.g., as shown in FIG. 20 described below). As is generally understood, when in its retracted position, the shade panel 102 may be configured to expose an adjacent architectural structure (e.g., a window), and, when in its extended position, the shade panel 102 may be configured to cover the adjacent architectural structure. In addition, the shade panel 102 may also be moved to any number of intermediate vertical positions defined between the fully retracted and fully extended positions so that the shade panel 102 partially covers the adjacent architectural structure.

It should be appreciated that, as used herein, the term "vertical" describes the orientation or arrangement of the covering 100 in its extended position (e.g., as indicated by arrow 108 in FIGS. 1-3), such as when the covering 100 is mounted for use relative to an adjacent architectural structure. Similarly, the term "horizontal" generally describes a direction perpendicular to vertical that extends side-to-side relative to the covering 100 (e.g., as indicated by arrow 110 in FIGS. 1 and 2). Similarly, the term "cross-wise" generally describes a direction perpendicular to both vertical and horizontal that extends front-to-back relative to the covering 100 (e.g., as indicated by arrow 111 in FIG. 3). The various directional references used herein are simply utilized to provide context to the embodiments shown in the figures and, thus, should not be construed as otherwise limiting the scope of the present subject matter.

In several embodiments, the shade panel 102 may include both a front panel 112 and a back panel 114, with the front and back panels 112, 114 being configured to be arranged generally parallel to each other in the vertical direction 108 when the shade panel 102 is moved to its extended position. In general, the panels 112, 114 may be formed from any material suitable for use within the disclosed covering 100, such as a textile, a woven and/or non-woven fabric, and/or the like. However, in several embodiments, one or both of the panels 112, 114 may be formed from a sheer fabric or other suitable material(s) that allows a least a portion of the light hitting the shade panel 102 to pass therethrough. Additionally, it should be appreciated that the front and back panels 112, 114 may generally be sized, as desired, for use relative to any suitable architectural structure. For instance the panels 112, 114 may define a vertical height 116 and/or horizontal width 118 sufficient to cover a window or other architectural structure, with such as a height 116 and/or width 118 corresponding to a conventional or standard size or a custom size made to fit customer specifications. In one embodiment, the front and back panels 112, 114 may define substantially the same height 116 and/or width 118 such that the panels 112, 114 are substantially coextensive when the shade panel 102 is in its extended position.

As shown in FIGS. 1-3, the shade panel 102 may also include a plurality of light blocking members or vanes 120 that extend between the front and back panels 112, 114, with the vanes 120 being spaced apart vertically from one another along the vertical height 116 of the shade panel 102. Specifically, in several embodiments, each vane 120 may be configured to extend the full depth or cross-wise distance 122 (FIG. 3) defined between the front and back panels 112, 114. For example, as particularly shown in FIG. 3, each vane 120 may include a front edge **120*a* coupled to the front panel 112 and a back edge 120*b* coupled to the back panel 114. In such an embodiment, the edges 120*a*, 120*b* of each vane 120 may be configured to be coupled to the front and back panels 112, 114 using any suitable means, such as by stitching, adhesives, mechanical fasteners and/or the like. Additionally, similar to the panels 112, 114, the vanes 120 may be formed from any material suitable for use within the disclosed covering 100, such as a textile, a woven and/or non-woven fabric, and/or the like. However, in a particular embodiment, the vanes 120 may be formed from a material that allows less light to pass therethrough than the material used to form the front and back panels 112, 114. For instance, each vane 120** may be formed from a light blocking or opaque material or a translucent material.

Figure 4:
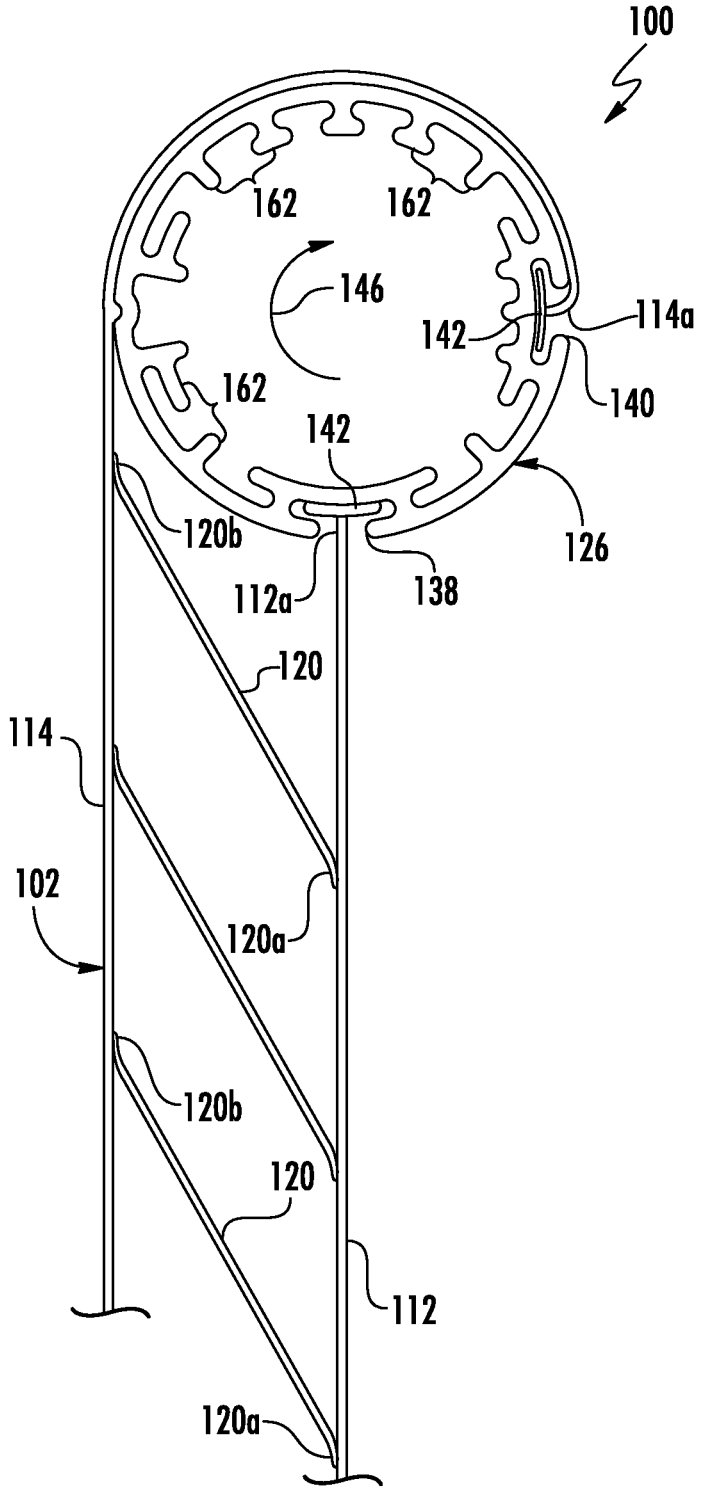
FIG. 4 illustrates a cross-sectional view similar to that shown in FIG. 3, particularly illustrating the covering after the vanes have been tilted to an intermediate position.
Figure 5:
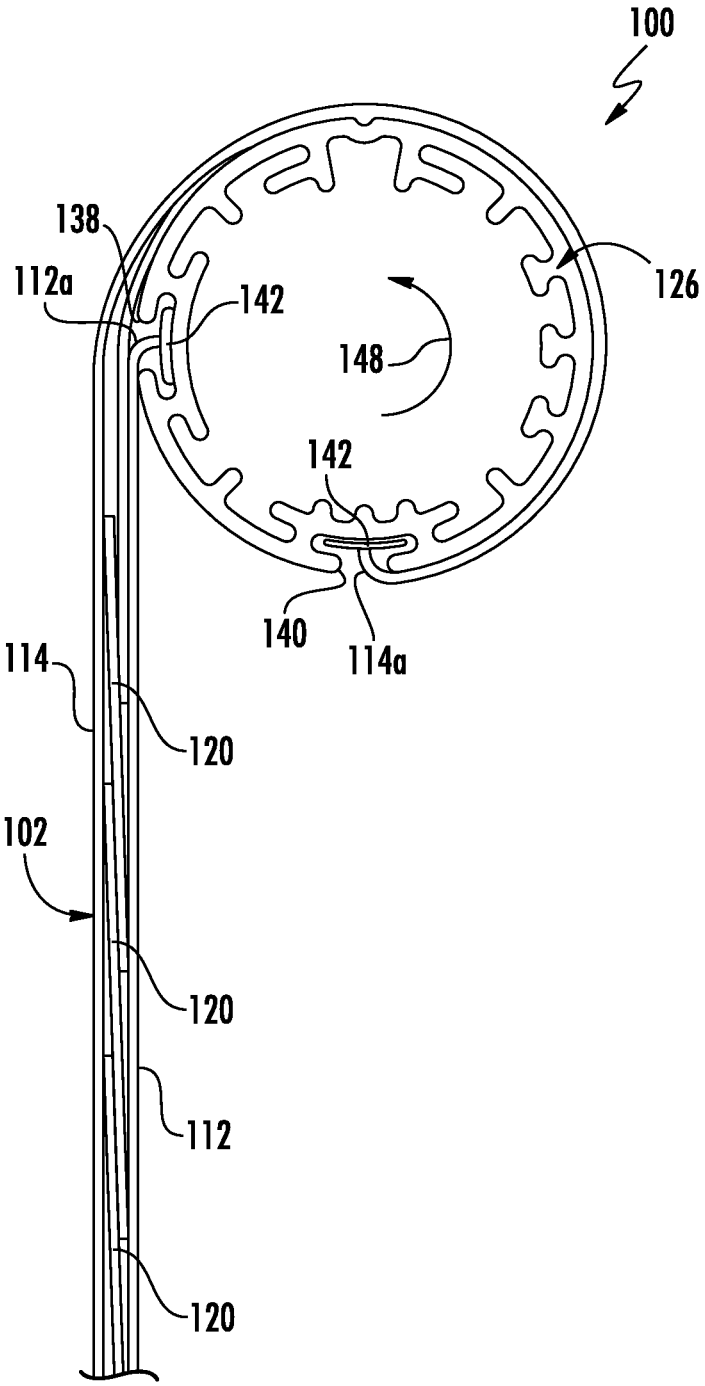
FIG. 5 illustrates another cross-sectional view similar to that shown in FIG. 3, particularly illustrating the covering after the vanes have been tilted to a closed position.

As will be described in greater detail below, when the shade panel 102 is positioned in its fully extended position, the relative positioning of the front and back panels 112, 114 may be adjusted such that the vanes 120 can be tilted, as desired, to control the amount of light passing through the shade panel 102. Specifically, in several embodiments, the shade panel 102 may be configured such that, when the front and back panels 112, 114 are moved vertically relative to each other (e.g., when the back panel 114 is raised and the front panel 112 is simultaneously lowered or when the back panel 114 is lowered and the front panel 112 is simultaneously raised), the orientation or tilt angle of the vanes 120 defined between the front and back panels is adjusted. For example, as shown in FIG. 3, the vanes 120 may be tilted to a substantially horizontal position between the panels 112, 114 such that a vertical light gap 124 is defined between each adjacent pair of vanes 120. In this "opened" position, light may pass directly through the light gaps 124 defined between the vanes 120. Alternatively, the vanes 120 may be tilted to an overlapping, substantially vertical position between the panels 112, 114 (e.g., as shown in FIG. 5 described below). In this "closed" position, the overlapping vanes 120 may serve to prevent all or a portion of the light hitting the shade panel 102 from passing therethrough. Additionally, the vanes 120 may be tilted to any number of intermediate tilt positions defined between the opened and closed positions (e.g., as shown in FIG. 4 described below). It should be appreciated that, in one embodiment, the vanes 120 may be spaced apart from one another and/or dimensioned such that, when moved to the opened position, the vanes 120 are oriented substantially horizontally between the vertically hanging panels 112, 114 and, when moved to the closed position, the shade panel 102 has a collapsed configuration in which both the vanes 120 and the panels 112, 114 hang in a substantially vertical orientation.

As particularly shown in FIG. 2, the roller assembly 104 of the disclosed covering 100 may include a roller 126 configured to support the both shade panel 102 and a lift assembly 128 that is configured to control the extension and retraction of the shade panel 102 between its extended and retracted positions. In addition, the roller assembly 104 may include and/or support a tilt adjustment mechanism 200 for controlling the tilt of the vanes 120 between their opened and closed positions. In several embodiments, the roller 126, the lift assembly 128, and the tilt adjustment mechanism 200 may be enclosed within a valence or other suitable covering. For instance, as shown in FIG. 2, the roller assembly 104 may include a headrail or cover 132 and corresponding endcaps 132*a*, 132*b* configured to at least partially encase the roller 126, the lift assembly 128, and the tilt adjustment mechanism 200. Moreover, various other components of the roller assembly 104 may also be configured to be positioned within the cover 132 and between the endcaps 132*a*, 132*b*, such as a limiter assembly 134 and a bearing 136. The operation of the various components of the roller assembly 104 will be described in more detail below with reference to FIGS. 6-12F.

In several embodiments, the roller 126 may correspond to a roller tube configured to be rotated about a longitudinal or horizontal axis that extends parallel or substantially parallel to the horizontal direction 110 of the covering 100. In general, the roller 126 may be configured to support the shade panel 102 vertically as well as to control the vertical movement of the shade panel 102. For instance, as shown in FIG. 3, upper edges 112*a*, 114*a* of the front and back panels 112, 114 may extend from the roller 126 such that the shade panel 102 hangs vertically from the roller 126. For instance, in one embodiment, an upper edge 112*a* of the front panel 112 may be coupled to the roller 126 by being held within a first elongated slot 138 of the roller 126 (e.g., via a connector strip 142) and an upper edge 114*a* of the back panel 114 may be coupled to the roller 126 by being held within a second elongated slot 140 of the roller 126 (e.g., via a connector strip 142). However, it should be appreciated that, in other embodiments, any other suitable attachment means may be used to couple the front and back panels 112, 114 to the roller 126.

In several embodiments, the specific circumferential location(s) of the connection points defined between the upper edges 112*a*, 114*a* of the panels 112, 114 and the roller 126 may be selected such that the shade panel 102 may be moved between its retracted and extended positions and the vanes 120 may be tilted between their opened and closed positions upon rotation of the roller 126. Specifically, in one embodiment, the connection points may be circumferentially offset by ninety degrees around the outer circumference of the roller 126, which results in a circumferential spacing of 270 degrees around the outer circumference of the roller 126 with respect to the interior of the shape panel 102. For example, as shown in FIG. 3, when the shade panel 102 is moved to its fully extended position and the vanes 120 are tilted to their fully opened position, the front panel 112 may, in one embodiment, be coupled to the roller 126 at the 3 o'clock position and the back panel 114 may be coupled to the roller at the 12 o'clock position when viewed from the left side of the roller 126. In other words, the front panel 112 may be coupled to the front of the roller 126 so as to hang directly down from its connection point with the roller 126 while the back panel 114 may be coupled to the top of the roller 126 and drape over the back side of the roller 126. In such an embodiment, the back panel 114 may be slightly longer than the front panel 112 to accommodate the different attachment locations on the roller 126 so that bottom edges 112*b*, 114*b* (FIG. 19) of the panels 112, 114 are both positioned at the same distance apart from the roller 126 and/or to allow the bottom rail assembly 106 to be maintained at a substantially horizontal orientation. Additionally, in this position, the vanes 120 may be disposed substantially parallel to one another and in a substantially horizontal position such that light may pass through the shade panel 102 at the locations of the light gaps 124 defined between the vanes 120.

It should be appreciated that, although the illustrated embodiment includes connection points defined between the upper edges 112*a*, 114*a* of the panels 112, 114 and the roller 126 that are spaced apart circumferentially by ninety degrees around the outer circumference of the roller 126, the connection points may be spaced apart around the outer circumference of the roller 126 by any other suitable degree that allows the disclosed covering 100 to function as described herein. For instance, in another embodiment, the connection points may be circumferentially offset by approximately 180 degrees around the outer circumference of the roller 126, such as by circumferentially offsetting the connection points around the outer circumference of the roller 126 within an offset range ranging from about 160 degrees to about 200 degrees. In a further embodiment, the connection points may be circumferentially offset by approximately 135 degrees around the outer circumference of the roller 126, such as by circumferentially offsetting the connection points around the outer circumference of the roller 126 within an offset range ranging from about 100 degrees to about 170 degrees. In yet another embodiment, the connection points may be circumferentially offset around the outer circumference of the roller 126 within an offset range ranging from about 80 degrees to about 100 degrees.

As indicated above, the disclosed covering 100 may also include a bottom rail assembly 106 configured to add weight to the bottom end of the shade panel 102. In addition, the bottom rail assembly 106 may also provide structure to allow the user of the covering 100 to manipulate the position of the shade panel 102 without having to touch the front and back panels 112, 114. As shown in FIG. 2, the bottom rail assembly 106 may include a bottom rail 144 configured to be coupled to the bottom edges 112*b*, 114*b* (FIG. 19) of the front and back panels 112, 114. The bottom rail 144 as well as additional components of the bottom rail assembly 106 will be described in greater detail below with reference to FIGS. 18-22.

Referring particularly now to FIGS. 3-5, one embodiment of the tilting action of the vanes 120 will generally be described. As indicated above, FIG. 3 illustrates a partial cross-sectional view of the covering 100 shown in FIG. 1 with the shade panel 102 being at its fully extended position and the vanes 120 being at their fully opened positions. FIGS. 4 and 5 illustrate similar cross-sectionals views as that shown in FIG. 3, particularly illustrating the vanes 120 as they are tilted from their fully opened position to an intermediate tilt position (FIG. 4) and from the intermediate tilt position to their fully closed position (FIG. 5).

As indicated above, the tilting of the vanes 120 may be controlled by the tilt adjustment mechanism 200 of the disclosed covering 100, which, as will be described in greater detail below, may be used to rotate the roller 126 along an angular range of motion in both a closing direction and an opening direction (e.g., by using a tilt wand 145 (FIG. 1) or any other suitable user control device). To tilt the vanes 120 to the closed position, the roller 126 may be rotated in the closing direction (e.g., in the clockwise direction indicated by arrow 146 in FIG. 3). As the roller 126 is rotated in the closing direction 146, the back panel 114 is wrapped around the roller 126 to raise the back panel 114 while the connection point between the front panel 112 and the roller 126 is moved from the 3 o'clock position to a 6 o'clock position (e.g., as represented by the roller rotation from FIG. 3 to FIG. 4) to lower the front panel 112. Accordingly, rotation of the roller 126 in the closing direction 146 may result in the back panel 114 being raised while the front panel 112 is simultaneously lowered, thereby resulting in the vanes 120 tilting away from their opened position towards their closed position (e.g., by tilting the vanes 120 to the intermediate tilt position shown in FIG. 4). Additionally, rotation of the roller 126 in the closing direction may result in the front panel 112 being moved towards the back panel 114, thereby reducing the depth or cross-wise distance 122 defined between the front and back panels 112, 114. For instance, as shown in FIG. 4, when the vanes 120 are located at the illustrated intermediate tilt position, the front panel 112 is located closer to the back panel 114 than when the vanes 120 are located at their fully opened position (e.g., as shown in FIG. 3).

As shown in FIG. 5, to tilt the vanes 120 from the intermediate tilt position shown in FIG. 4 to the fully closed position (shown in FIG. 5), the roller 126 may be rotated further in the closing direction 146 such that the back panel 114 is further wrapped around the roller 126 (e.g., so that the connection between the back panel 114 and the roller 126 moves to the 6 o'clock position) and the connection point between the front panel 112 and the roller 126 moves towards the 9 o'clock position. As the roller 126 is rotated, the vanes tilt to the fully closed position, at which point each vane 120 is oriented substantially vertically and overlaps or is otherwise positioned adjacent to its neighboring vanes 120. Moreover, as shown in FIG. 5, when the vanes 120 are at their fully closed positions, the front panel 112 is positioned substantially adjacent to the back panel 114 such that the shade panel 102 has a substantially flat configuration in the cross-wise direction 111.

It should be appreciated that, after tilting the vanes 120 to the closed position shown in FIG. 5, further rotation of the roller 126 in the closing direction 146 may result in the shade panel 102 being wound around the roller 126, thereby causing the shade panel 120 to be raised from its fully extended position. In such instance, the substantially flat configuration assumed by the shade panel 102 may facilitate winding the panel 102 around the roller 126 as the shade panel 102 is being raised. As should be readily appreciated, the shade panel 102 may be wound around the roller 126 until the panel 102 reaches its fully retracted position, at which point all or substantially all of the shade panel 102 is wrapped around the roller 126 and the bottom rail 144 is positioned directly adjacent to the wrapped roller 126. Additionally, as indicated above, the shade panel 102 may also be partially wrapped around the roller 126 as it being raised from the fully extended position to any number of intermediate vertical positions defined between the fully extended and fully retracted positions. As will be described below, the lift assembly 128 may be used to control the rotation of the roller 126 as the shade panel 102 is being raised from its fully extended position to its fully retracted position and may also function to hold the shade panel 102 in place at any desired intermediate vertical position.

Additionally, to lower shade panel 102 back towards its fully extended position, a component of the bottom rail assembly 106 (e.g., the bottom rail 144 or a user control device associated with the bottom rail assembly 106, such as a handle) may be pulled downward to the cause the roller 126 to rotate in a lowering direction (e.g., in the counter-clockwise direction indicated by arrow 148 in FIG. 5) opposite the closing direction 146. In such instance, the movement of the shade panel 102 described above is reversed. Specifically, the shade panel 102 may be unwound from the roller 126 until it reaches the desired, lowered position. For example, the shade panel 102 may be lowered to any suitable intermediate vertical position at which the vanes 120 remain closed and the shade panel 102 maintains its substantially flat configuration. Similarly, the shade panel 102 may be lowered to its fully extended position, at which point the vanes 120 may be tilted to any suitable tilt position defined between their opened and closed positions.

Referring now to FIGS. 6-11, several views of various components of the lift assembly 128 shown in FIG. 2 are illustrated in accordance with aspects of the present subject matter. As shown in the illustrated embodiment, the lift assembly 128 may generally include a spring driven motor 150 that is configured to store energy when the shade panel 102 is extended. The stored energy may then be used to rotate the roller 126 in the closing/raising direction 146 when the shade panel 102 is being retracted to facilitate winding of the shade panel 102 around the roller 126 and to assist the user in raising the shade panel 102. Additionally, the lift assembly 126 may also include a clutch assembly 152 configured to be used in conjunction with the spring motor 150 to lock the roller in position, thereby preventing rotation of the roller 126 when the shade panel 102 is at its fully extended position, its fully retracted position, and/or any desired intermediate vertical position.

It should be appreciated that, in general, the spring motor 150 and associated clutch assembly 152 may have any suitable configuration consistent with the disclosure provided herein. For instance, in several embodiments, the clutch assembly 152 may operate to lock the roller 126 in position at predetermined degrees of rotation. For example, the clutch assembly 152 may be capable of locking the roller 126 every 180 degrees of rotation or every 90 degrees of rotation, or every 60 degrees of rotation or every 45 degrees of rotation or every 30 degrees of rotation, with at least one of the locked positions corresponding to the fully extended position for the roller shade 102. Additionally, it should be appreciated that the lift assembly 128 may include any number of components configured to ensure desirable operation of the covering 100, such as a damper 151 and the limiter assembly 134 (FIG. 2). As is generally understood, the damper 151 may be used to dampen the rotation of the roller 126 when the spring force of the spring motor 150 is applied to the roller 126 to prevent explosive rotation of the roller 126. Moreover, the limiter assembly 134 may be used to limit the distance that the shade panel 102 may be retracted. For instance, the limiter assembly 134 may be used in situations where the user would be unable to reach the bottom edge of the shade panel 102 if the panel 102 was raised to its fully retracted position.

Figure 6:
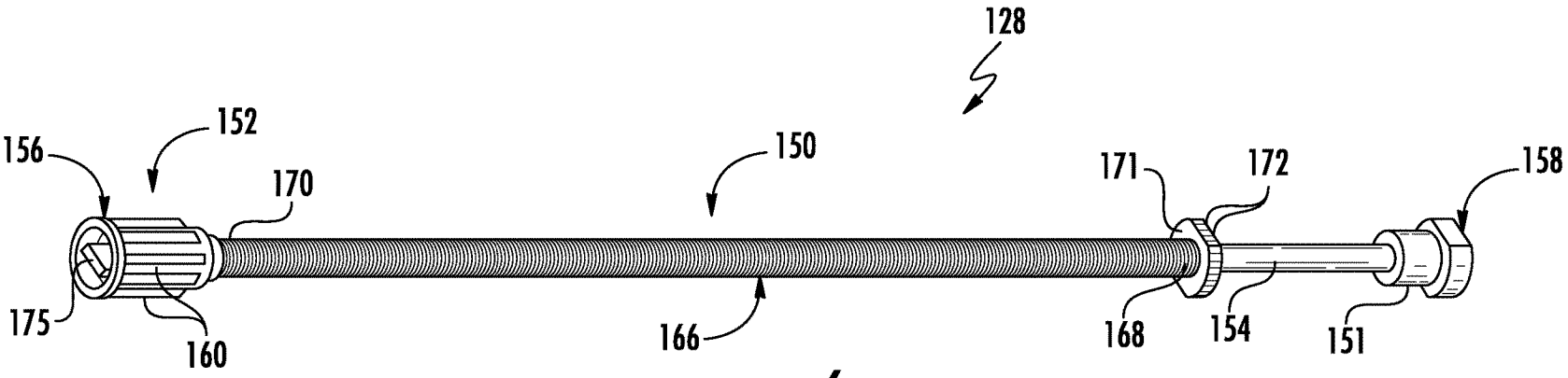
FIG. 6 illustrates a perspective view of one embodiment of a lift assembly suitable for use within the covering shown in FIG. 1.
Figure 7:
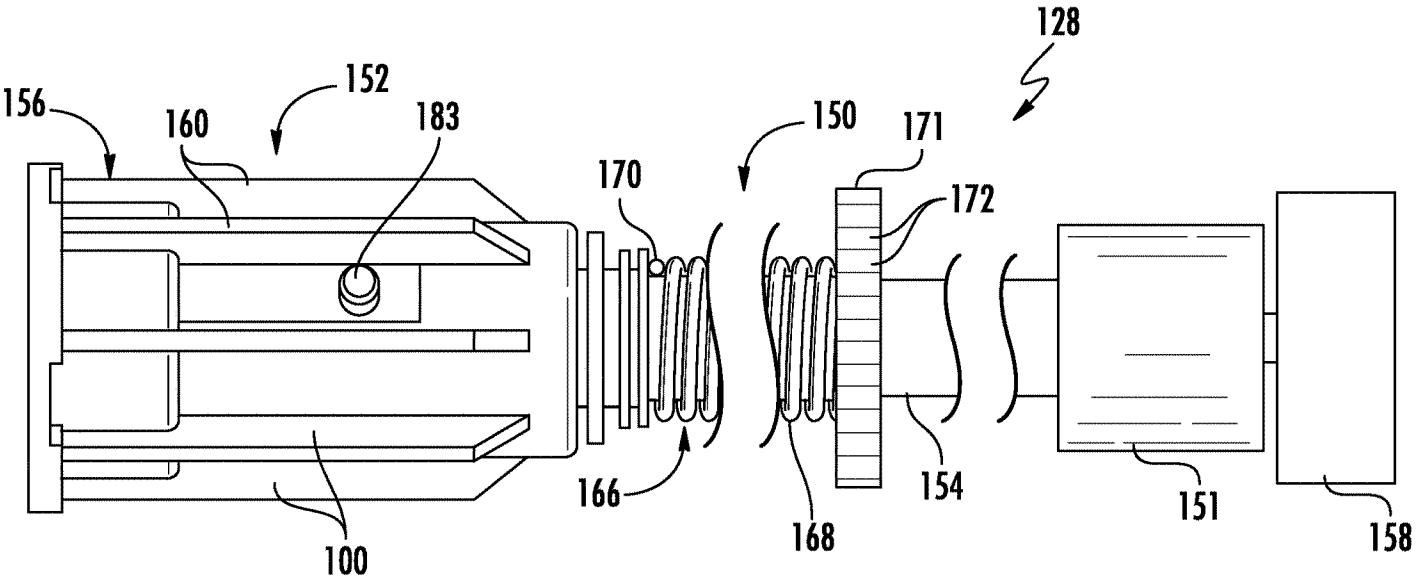
FIG. 7 illustrates a partial, side view of the lift assembly shown in FIG. 6.
Figure 8:
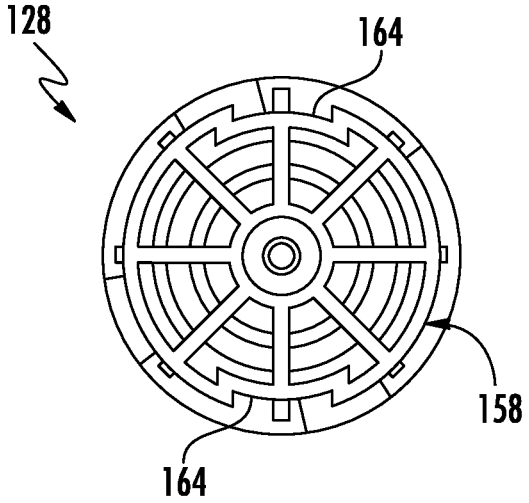
FIG. 8 illustrates an end view of a first end of the lift assembly shown in FIGS. 6 and 7.
Figure 9:
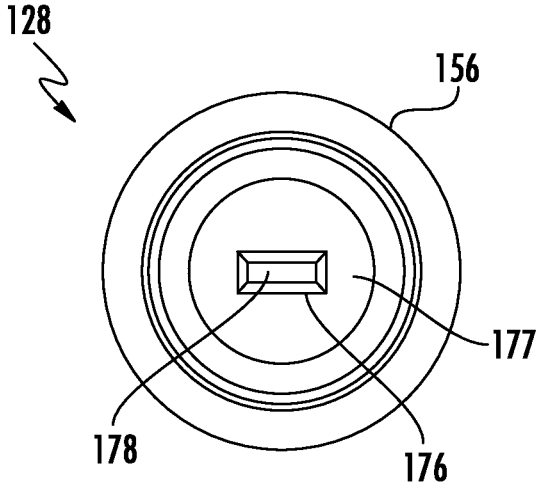
FIG. 9 illustrates an end view of a second, opposed end of the lift assembly shown in FIGS. 6 and 7.
Figure 10:
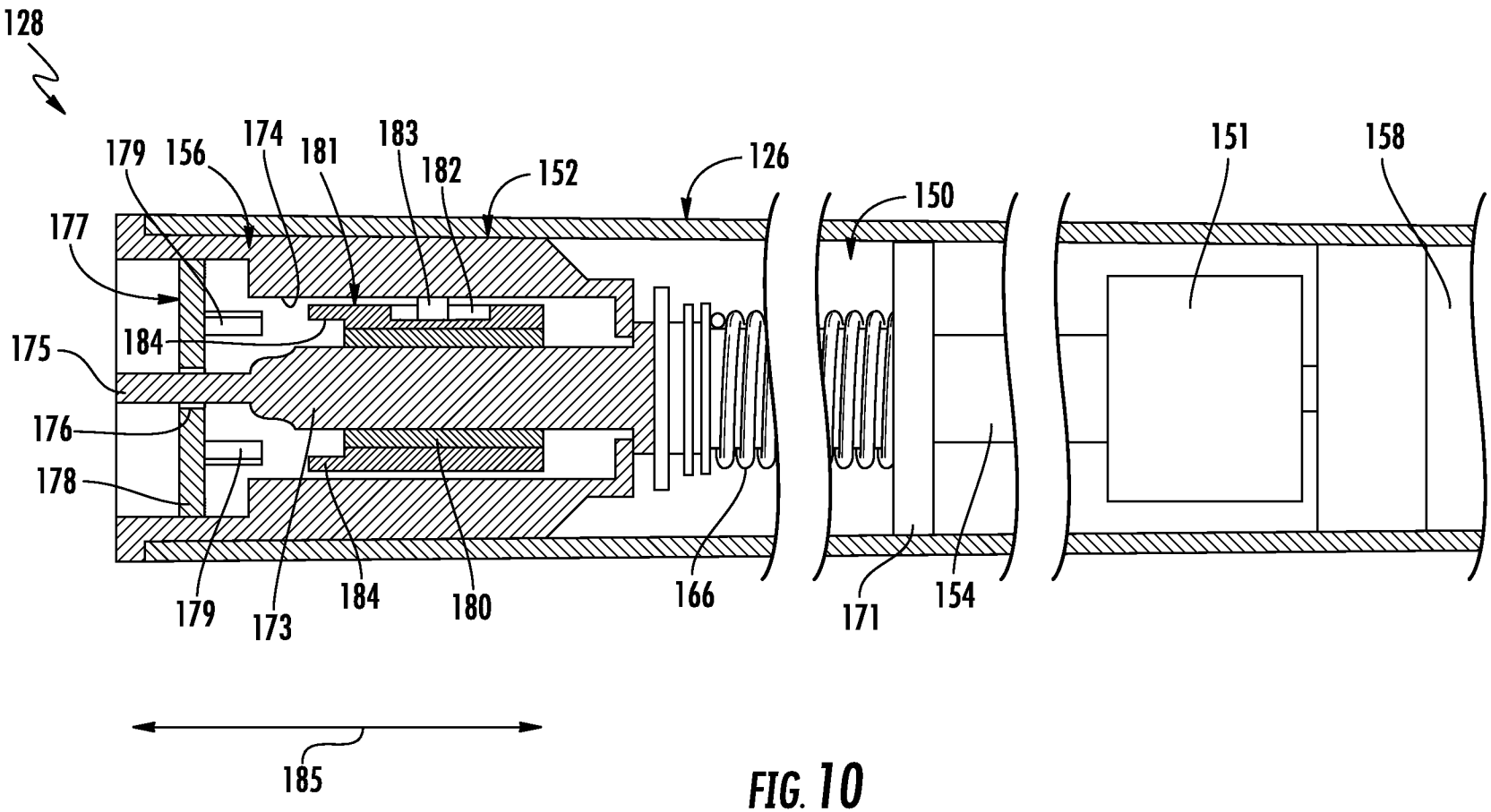
FIG. 10 illustrates a cross-sectional view of the lift assembly shown in FIG. 7 as installed within a roller of the covering.

As shown in the illustrated embodiment, the lift assembly 128 may include a roller shaft 154 that is configured to extend lengthwise within the roller 126 along at least a portion of the longitudinal axis of the roller 126. The roller shaft 154 may also define the rotational axis of the roller 126. As shown in FIGS. 6 and 7, the roller shaft 154 may include a first connector 156 at one end and a second connector 158 at its opposite end, with the first and second connectors 156, 158 being supported on the shaft 154 for rotation relative thereto. The connectors 156, 158 may generally be configured to be rotatably coupled to the roller 126 such that the roller 126 and the connectors 156, 158 rotate in unison. For instance, when the lift assembly 128 is inserted or otherwise assembled within the roller 126 (e.g., as shown in FIG. 10), the connectors 156, 158 may be configured to engage the interior of the roller 126 such that the roller 126 and the connectors 156, 158 are constrained for rotation together. In one embodiment, to facilitate engagement between the connectors 156, 158 and the roller 126, each connector 156, 158 may include suitable engagement structure that is configured to be engaged with corresponding engagement structure on the roller to allow the connectors 156, 158 to be rotationally coupled to the roller 126. For instance, as shown in FIG. 7, the first connector 156 may include outwardly extending splines 160 configured to engage corresponding ribs 162 (e.g., as shown in FIGS. 3-5) extending within the interior of the roller 126. Similarly, as shown in FIG. 8, the second connector 158 may define recesses 164 configured to engage the interior ribs 162 of the roller 126. However, in other embodiments, the connectors 156, 158 and the roller 126 may include any other suitable engagement structure that allows the connectors 156, 158 to rotatably engage the roller 126.

As will be described below, one end of the roller 126 may be vertically supported by the engagement provided between the first connector 156 and the tilt adjustment mechanism 200. Additionally, in several embodiments, the opposed end of the roller 126 may be supported for rotational motion via the bearing 136 (FIG. 2) of the roller assembly 104. For instance, in one embodiment, the bearing 136 may be rotationally coupled to the roller 126 via the limiter assembly 134 (FIG. 2). In such an embodiment, the limiter assembly 134 may be directly coupled to the roller 126 or indirectly coupled to the roller 126, such as via a separate connector (e.g., the second connector 158). Alternatively, the bearing 136 may be rotationally coupled to the roller 126 via a separate connector configured to engage the roller 126, such as the second connector 158, without requiring the limiter assembly 134.

Additionally, as shown in FIGS. 6 and 7, a torsion spring 166 may be mounted on the roller shaft 154 that extends between a first end 168 and a second end 170. In several embodiments, the first end 168 of the spring 166 may be coupled to a plate 171 rotatably supported on the roller shaft 154 such that the plate 171 is configured to rotate relative to the shaft 154. Additionally, the plate 171 may be configured to rotationally engage the roller 126. As such, when the roller 126 and the plate 171 are rotated together, the first end 168 of the spring 166 may be rotated with the roller 126 relative to the roller shaft 154. To facilitate such engagement between the plate 171 and the roller 126, the plate 171 may include suitable engagement structure configured to engage corresponding engagement structure on the roller 126. For instance, in the illustrated embodiment, the plate 171 includes splines 172 extending outwardly therefrom that are configured to engage the interior ribs 162 of the roller 126. However, in other embodiments, the plate 171 and the roller 126 may include any other suitable engagement structure that allows such components to be rotatably coupled to each other.

Additionally, the second end 170 of the spring 166 may be fixed or otherwise coupled to the roller shaft 154 such that the second end 170 of the spring 166 is configured to rotate with the shaft 154. As such, when the roller 126 is rotated relative to the roller shaft 154, the spring 166 may be twisted between its fixed second end 170 and its rotating first end 168 to allow the spring 166 to store energy as the shade panel 102 is being lowered. It should be appreciated that the second end 170 of the spring 166 may be fixedly coupled to the shaft 154 using any suitable connection means, such as one or more mechanical fasteners, a press-fitting, using any other suitable mechanical engagement between the shaft 154 and the second end 170 of the spring 166 and/or like.

Referring particularly to FIG. 10, the lift assembly 128 may also include a transmissions shaft 173 that extends from and/or is fixed to the end of the roller shaft 154 supporting the first connector 156. In one embodiment, the transmission shaft 173 may correspond to an elongated post or coupling that is configured to extend lengthwise from the end of the roller shaft 154 through a cylindrical bore 174 defined by the first connector 156. Alternatively, the transmission shaft 173 may be formed integrally with the roller shaft 154. Additionally, as shown in FIG. 10, a transmission end 175 of the transmission shaft 173 disposed opposite the roller shaft 154 may be configured to be received within an aperture 176 of a locking member 177 of the clutch assembly 152 such that the transmission shaft 173 engages the locking member 177. For instance, in one embodiment, the transmission end 175 of the transmission shaft 173 may be formed to have a non-round shape, such as a rectangular shape. In such an embodiment, the aperture 176 defined by the locking member 177 may be configured to define a corresponding non-round shape, such as a rectangular shape, to prevent any or substantially any relative rotation between the locking member 177 and the transmission shaft 173. The locking member 177 may, in turn, include a radially extending body 178 that is received within an enlarged end of the cylindrical bore 174 of the first connector 156 to allow the locking member 177 to rotate freely relative to the connector 156. In addition, as shown in FIG. 10, the locking member 177 may also include engagement members, such as tabs or fingers 179, that extend axially from the body 178 of the locking member 177 in the direction of the roller shaft 154.

Moreover, as shown in FIG. 10, a cylindrical bearing sleeve 180 may be mounted on the transmission shaft 173 in a manner that prevents relative rotation between the bearing sleeve 180 and the transmission shaft 173. For instance, in one embodiment, the internal bore of the bearing sleeve 180 may be formed with suitable engagement structure, such as splines or recesses (not shown), configured to engage corresponding engagement structure on the transmission shaft 173, such as ribs, etc. (not shown), to prevent relative rotation between the bearing sleeve 180 and the transmission shaft 173 while allowing the bearing sleeve 180 to translate axially along the length of the transmission shaft 173. Alternatively, the bearing sleeve 180 and the transmission shaft 173 may be coupled to each another using any other suitable means that allows the components to function as described herein.

Figure 11:
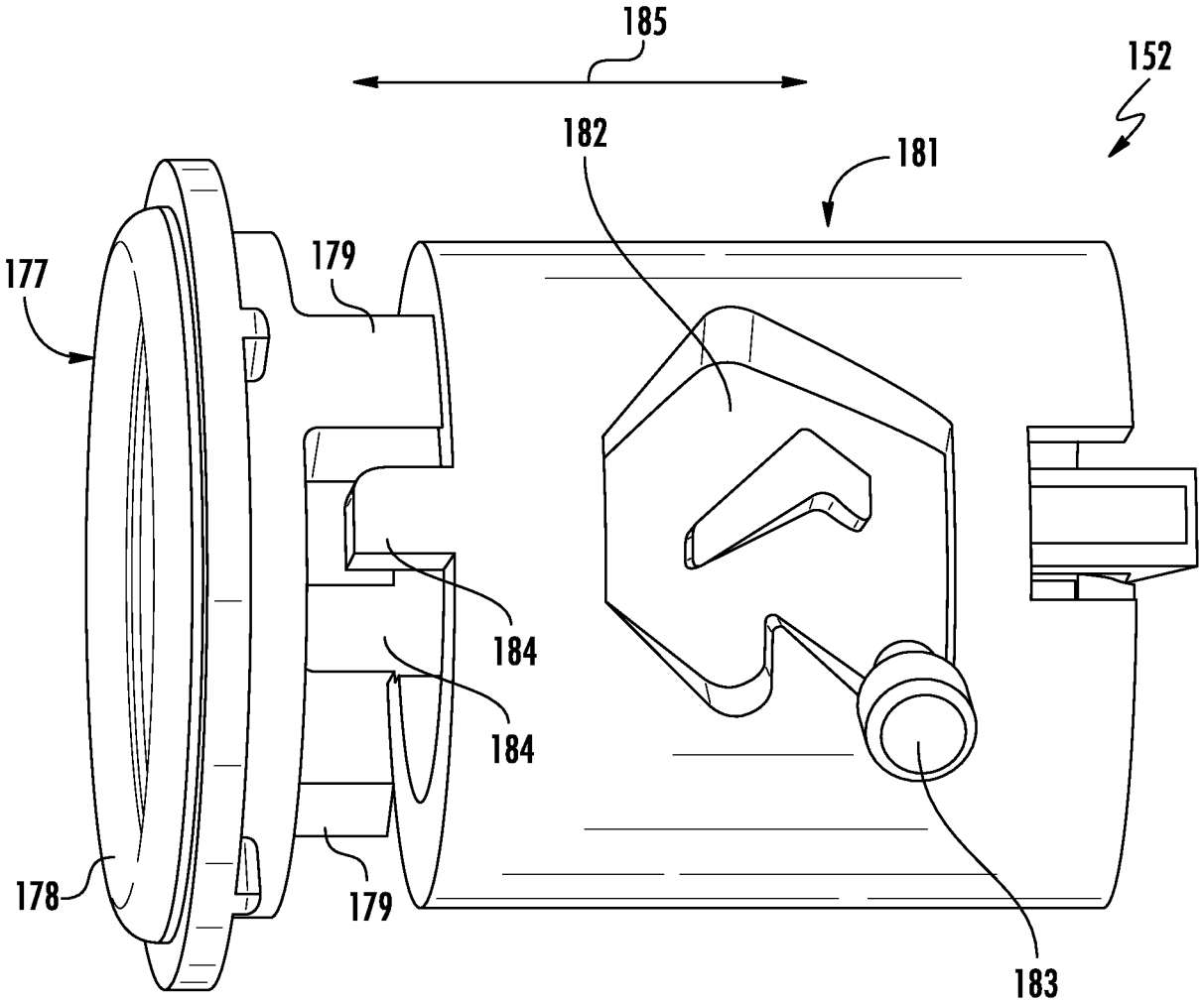
FIG. 11 illustrates a perspective view of one embodiment of a cam drum and a locking member of a clutch assembly suitable for use within the covering shown in FIG. 1.

Additionally, the clutch assembly 152 may include a cylindrical cam drum 181 mounted around the outer perimeter of the bearing sleeve 180 in a manner that allows the cam drum 181 to rotate freely relative to the bearing sleeve 180. As shown in FIG. 10, the cam drum 181 may be located within the cylindrical bore 174 defined by the first connector 156. Additionally, the cam drum 181 may define a cam track 183 (e.g., as shown in FIG. 11) along a portion of its outer perimeter that is configured to receive a corresponding cam pin 183 extending inwardly from the first connector 156. For instance, in one embodiment, the cam pin 183 may be inserted through an opening (not shown) defined through the wall of the first connector 156 such that the cam pin 183 extends radially inwardly into the bore 176 defined by the first connector 156 and is received within the cam track 182 defined by the cam drum 181. The cam drum 181 may also include suitable engagement members, such as tabs or fingers 184, extending axially from the drum 181 in the direction of the locking member 177.

In general, the cam track 182 defined by the cam drum 181 may be shaped such that, when the roller 126 is rotated to move the shade panel 102 to its extended position, the cam pin 183 engages the track 182 in a manner that allows the cam drum 181 to rotate relative to the bearing sleeve 180, thereby allowing the first connector 156 (and, thus, the roller 126) to rotate relative to both the roller shaft 154 and the transmission shaft 173. Such rotation of the roller 126 relative to the roller shaft 154 may allow the spring 166 of the spring motor 150 to store energy as the shade panel 102 is being lowered. Additionally, when the rotation of the roller 126 is stopped by the user, the cam pin 183 may traverse the cam track 182 in a manner that translates the cam drum 181 and the bearing sleeve 180 axially along the transmissions shaft 173 in the direction of the locking member 177 (e.g., in the direction of arrow 185 in FIG. 10). Such axial motion of the cam drum 181 and the bearing sleeve 180 in the direction of the locking member 177 may serve to locate the cam drum 181 relative to the locking member 177 such that the fingers 179 of the locking member 177 engage the corresponding fingers 184 of the cam drum 181, thereby fixing the roller 126 to the roller shaft 154 via the connection made through the fingers 179, 184, the pin 183, and the cam drum 181 to prevent further rotation of the roller 126. Thereafter, when the shade panel 102 is slightly extended or lowered, the cam pin 183 may be translated along the cam track 182 in a manner that causes the cam drum 181 to be translated axially away from the locking member 177, thereby disengaging the cam drum 181 from the locking member 177. Such disengagement of the cam drum 181 from the locking member 177 may then allow the roller 126 to again be rotated relative to the roller shaft 154. For instance, the disengagement of the cam drum 181 from the locking member 177 may allow the spring motor 150 to function to rotate the roller 126 in a manner that raises the roller shaft 102 towards its fully retracted position.

Figure 12A:
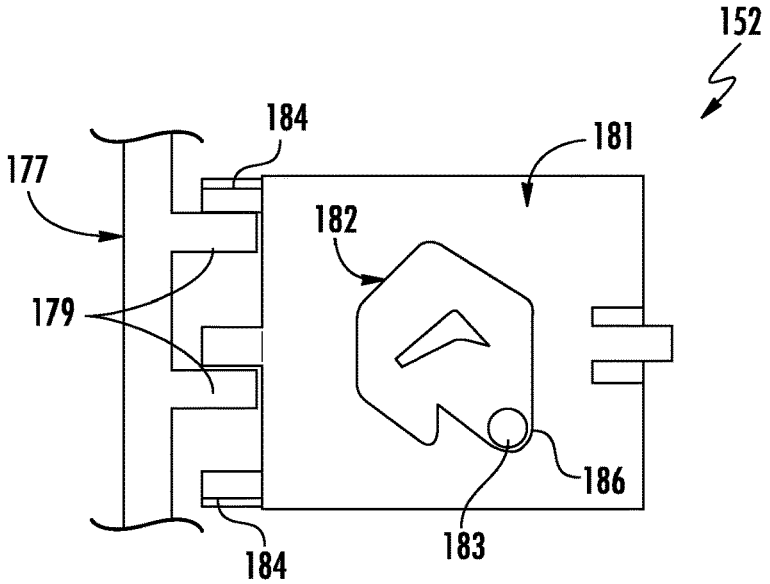
FIGS. 12A-12F illustrate the motion of a cam pin as it traverses a track defined by the cam pin shown in FIG. 11 to move the clutch between an unlocked position and a locked position.
Figure 12B:
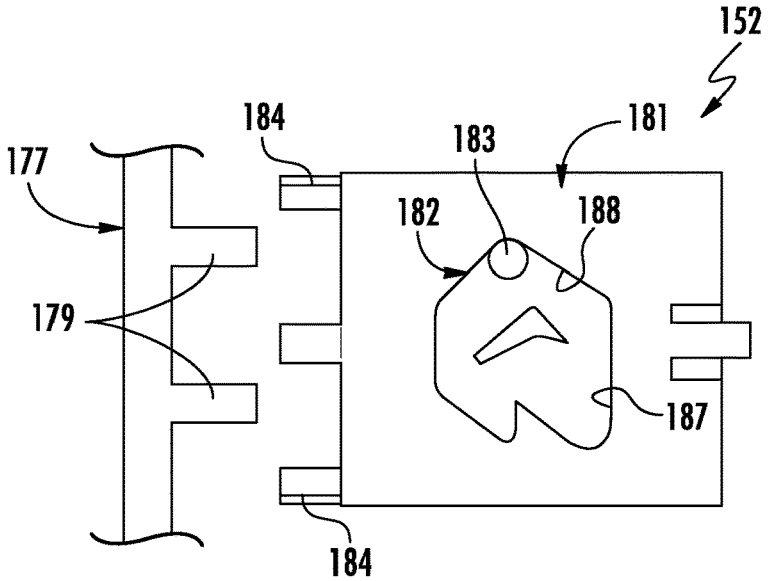
Figure 12C:
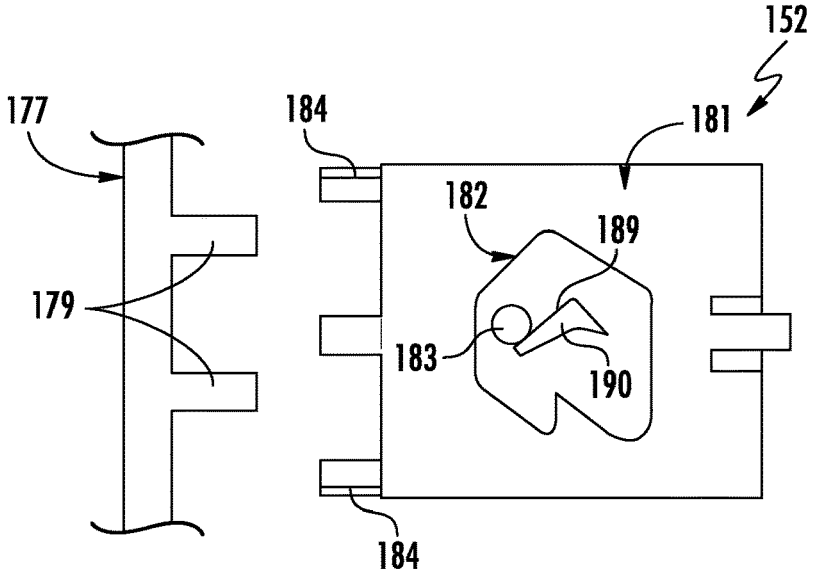
Figure 12D:
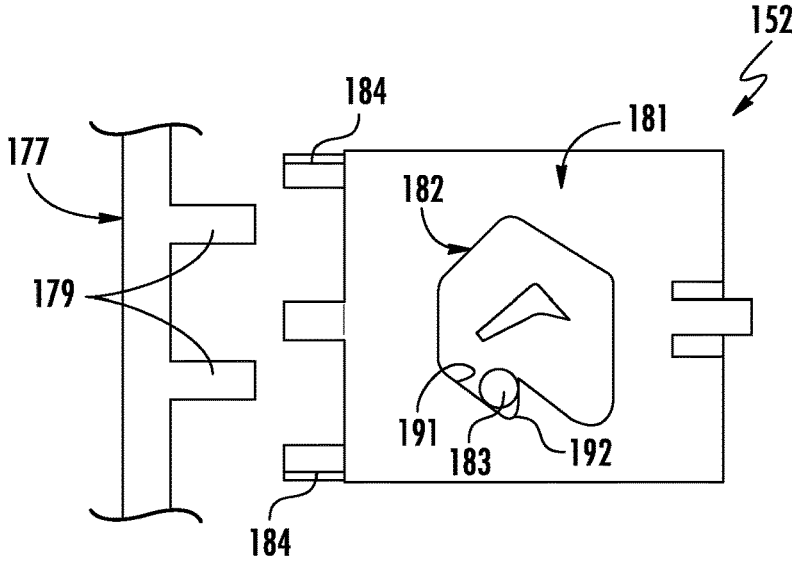
Figure 12E:
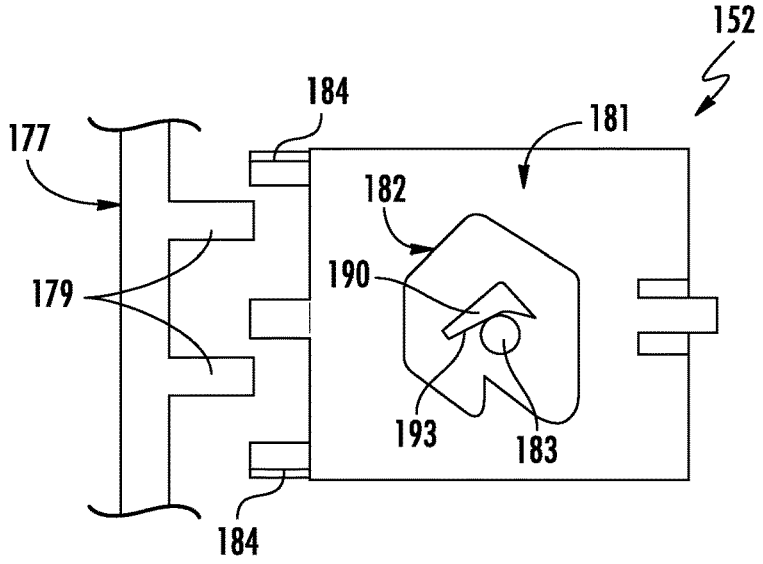
Figure 12F:
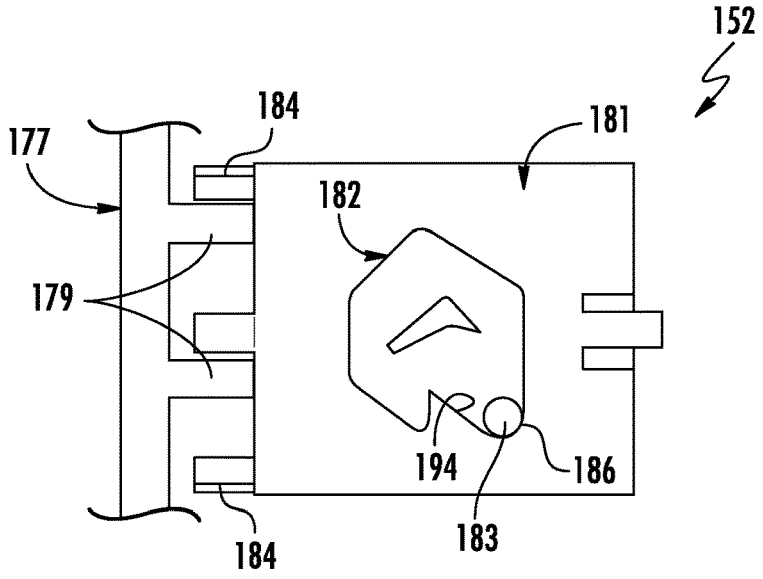

The operation of a specific embodiment of the engagement between the cam pin 183 and the cam track 182 will now be described with reference to FIGS. 12A-12F, particularly illustrating the travel path of the cam pin 182 within the track 182. Specifically, FIG. 12A illustrates the cam drum 181 in the locked position relative to the locking member 177, with the fingers 179 of the locking member 177 engaged with the corresponding fingers 184 of the cam drum 181. As shown in FIG. 12A, when the cam drum 181 is in the locked position, the cam pin 183 is disposed in a first groove 186 formed in the cam track 182 and the cam drum 181 is located at its closest axial position relative to the locking member 177. As shown in FIG. 12B, to unlock the roller 126, the shade panel 126 may be pulled slightly downward by the user to cause the roller 126 to rotate in the opening/lowering direction. Such rotation of the roller 126 results in the cam pin 183 traversing both a first face 187 and a second face 188 of the cam track 182. As shown in FIG. 12B, the angle of the second face 188 causes the cam drum 181 (and the bearing sleeve 180) to move axially away from the locking member 177 to disengage the locking fingers 179, 184. Thereafter, as shown in FIG. 12C, when the user releases the force on the shade panel 102, the spring motor 150 may be allowed to rotate the roller 126 in the opposite, closing/raising direction, causing the cam pin 183 to strike a first angled surface 189 of a projection 190 extending within the cam track 182 and forcing the cam drum 181 further away from the locking member 177. As shown in FIG. 12D, further rotation of the roller 126 in the closing/raising direction 146 may cause the cam pin 183 to traverse a third face 191 of the cam track 182 and enter a second groove 192 of the track 182. The cam drum 181 may then remain in this unlocked position as the roller 126 is rotated to move the shade panel 102 towards its fully retracted position. Additionally, referring to FIG. 12E, to stop the rotation of the roller 126, the movement of the shade panel 102 is stopped by the user, which causes the cam pin 183 to engage a second angled surface 193 of the projection 190. As the cam pin 183 traverses the second angled surface 193, the cam drum 181 is moved axially towards the locking member 177 and the locked position. Thereafter, as shown in FIG. 12F, when the shade panel 102 is released, the cam pin 183 traverses a fourth face 194 of the cam track 182 until the pin 192 reaches the first groove 186. As indicated above, in this position, the fingers 179 of the locking member 177 are engaged with the fingers 184 of the cam drum 181 to lock the cam drum 181 and, thus, the roller 126 in position. The cam drum 181 and the roller 126 will then remain in the locked position until the user again pulls down on the shade panel 102 to disengage the cam drum 181 from the locking member 177.

It should be appreciated that, in several embodiments, both the circumferential spacing of the locking fingers 179, 184 and the shape of the cam track 182 may be configured such that the roller 126 may be locked in position every predetermined number of degrees of rotation of the roller 126. For example, as indicated above, the clutch assembly 152 may be capable of locking the roller 126 every 180 degrees of rotation, or every 90 degrees of rotation, or every 60 degrees of rotation or every 45 degrees of rotation or every 30 degrees of rotation. In doing so, it is desirable for at least one of the locked positions of the roller 126 to correspond to the fully extended position for the covering 102.

Figure 13:
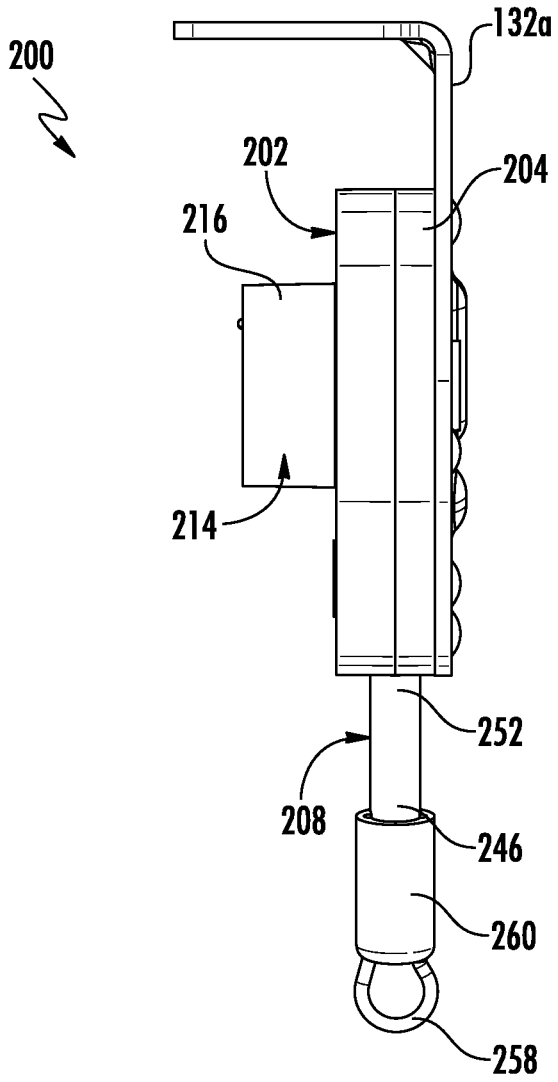
FIG. 13 illustrates a back view of one embodiment of a tilt adjustment mechanism suitable for use within the covering shown in FIG. 1.
Figure 14:
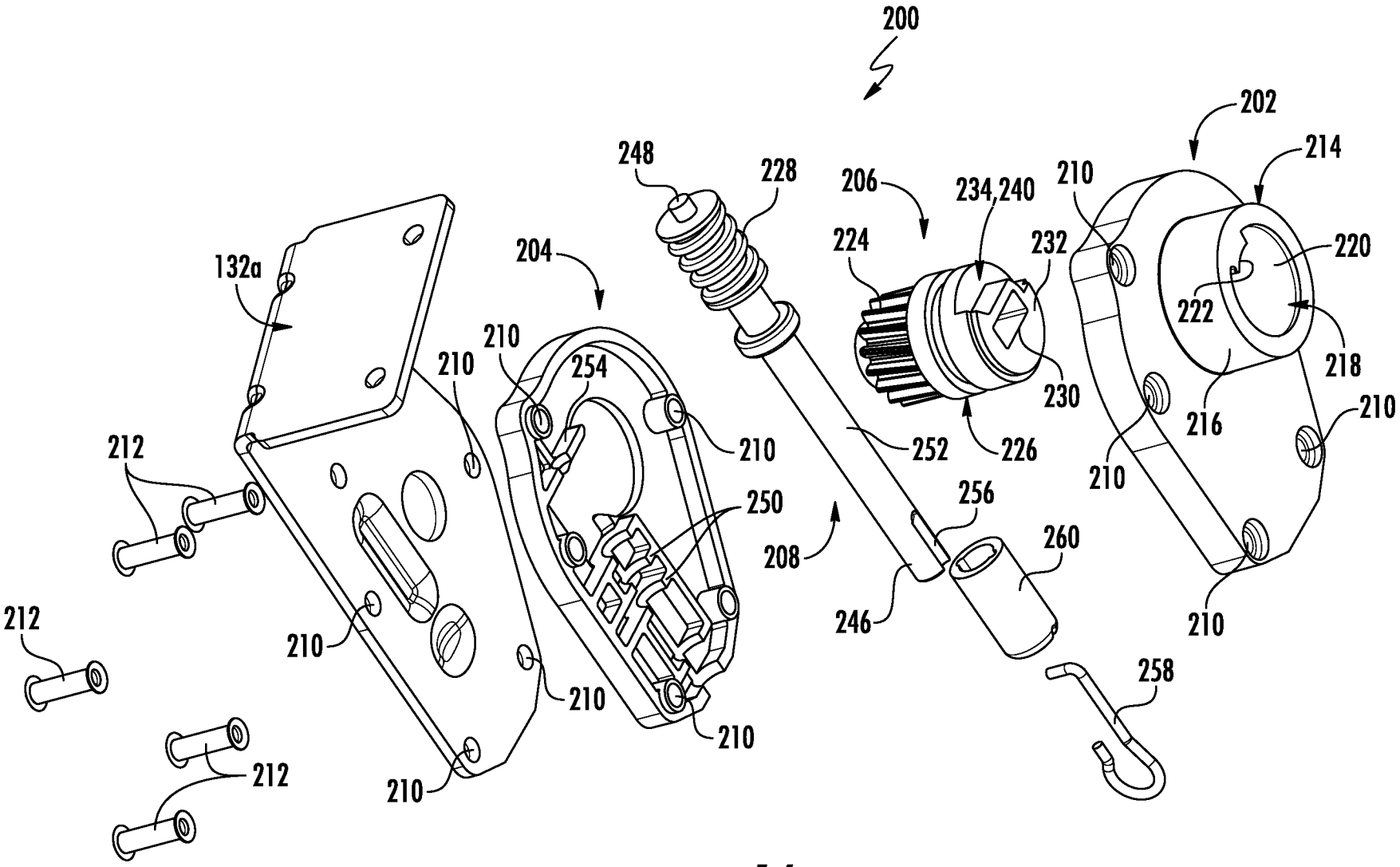
FIG. 14 illustrates an exploded, perspective view of the tilt adjustment mechanism shown in FIG. 13.

Referring now to FIGS. 13-17, several views of various component of one embodiment of the tilt adjustment mechanism 200 described above are illustrated in accordance with aspects of the present subject matter. As shown, the tilt adjustment mechanism 200 may include a housing formed by an inner housing member 202 and an outer housing member 204. In general, the inner and outer housing members 202, 204 may be configured to be coupled to one another to encase and/or support one or more of the various other components of the tilt adjustment mechanism 200, such as a tilt drive shaft 206 and a tilt drive actuator 208. As shown in FIGS. 13 and 14, the inner and outer housing members 202, 204 may, in one embodiment, define matching shapes or outer profiles. As such, when the housing members 202, 204 are coupled together, the resulting housing may define a smooth outer profile with a flush joint between the inner and outer housing members 202, 204. Additionally, it should be appreciated that the inner and outer housing members 202, 204 may be configured to be coupled to each other using any suitable coupling members, such as fasteners, adhesives, etc. For instance, as shown in FIG. 14, in one embodiment, the inner and outer housing members 202, 204 may each define fastener openings 210 configured to receive suitable mechanical fasteners for coupling the housing members 202, 204 together. In such an embodiment, the fasteners may simply be used to couple the housing members 202, 204 together. Alternatively, the fasteners may also be used to couple the housing members 202, 204 to another adjacent component of the covering 100. For instance, as shown in FIG. 14, suitable fasteners 212 (e.g., rivets) may be inserted through both the housing members 202, 204 and the adjacent end cap 132*a* of the covering 100 to couple such components to one another.

In several embodiments, the inner housing member 202 may include a stub shaft 214 extending outwardly therefrom that is configured to be received within the cylindrical bore 174 defined by the first connector 156 such that an outer circumferential surface 216 (FIGS. 13 and 14) of the stub shaft 214 defines a bearing surface for rotation of the connector 156 relative to the stub shaft 214. Additionally, an axial shaft opening 218 may be defined through the stub shaft 214 that forms an inner circumferential surface 220 (FIG. 14) for the stub shaft 214. This inner circumferential surface 220 may, in turn, define a bearing surface for rotation of a portion of the tilt drive shaft 206 relative to the stub shaft 214. As will be described below with reference to FIG. 17, in one embodiment, the stub shaft 214 may also include an inner rib 222 extending radially inwardly from its inner circumferential surface 220 that is configured to serve as a mechanical stop for the tilt drive shaft 206.

Figure 17:
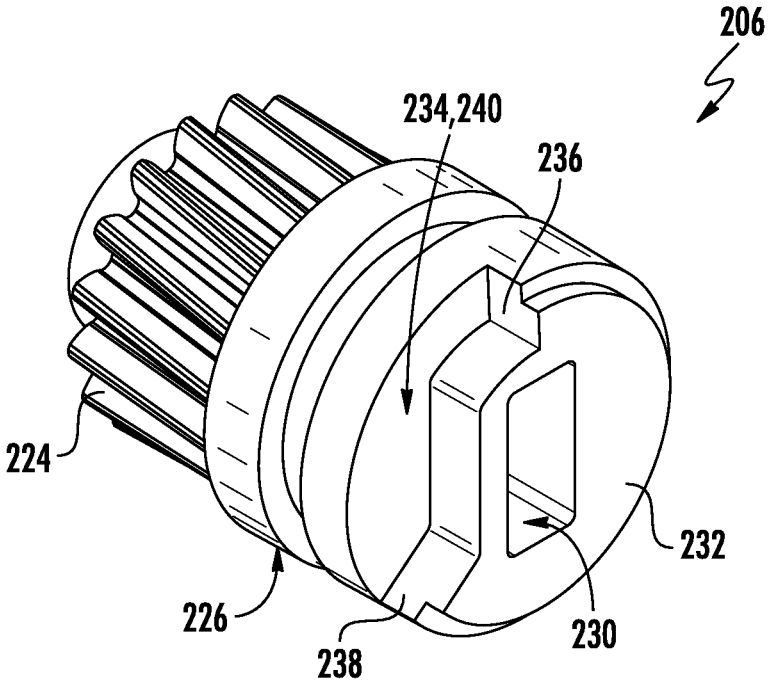
FIG. 17 illustrates a perspective of the tilt drive shaft of the tilt adjustment mechanism shown in FIG. 13.

As particularly shown in FIGS. 14 and 17, the tilt drive shaft 206 may include a tilt gear 224 at one axial end of the drive shaft 206 and a shaft portion 226 at the opposed axial end of the drive shaft 204. As will be described below, the tilt gear 224 may generally be configured to mesh with a corresponding worm gear 228 of the tilt drive actuator 208 to allow rotational motion of the actuator 208 about its longitudinal axis to be converted into rotational motion of the drive shaft 204 about a rotational axis extending generally parallel to the rotational axis of the roller shaft 154. Additionally, as shown in FIG. 17, the tilt drive shaft 206 may include an opening 230 defined through an end face 232 of the shaft portion 226 that is configured to receive the portion of the transmission end 175 of the transmission shaft 173 extending axially beyond the locking member 177 within the roller 126. For example, as shown in FIG. 17, in one embodiment, the opening 230 may be non-round, such as a rectangular-shaped opening, to match the non-round shape of the transmission end 175 of the transmission shaft 173. As such, when the tilt drive shaft 206 is inserted within the shaft opening 218 of the stub shaft 214 so that the end face 232 of the shaft portion 226 is aligned with an end face of the stub shaft 214 and the tilt adjustment mechanism 200 is installed relative to the roller 126, the transmission end 175 of the transmission shaft 173 may be received within the opening 230 defined by the tilt drive shaft 206. Such engagement of the tilt drive shaft 206 with the transmission shaft 173 may provide a rotational connection between the tilt drive shaft 206 and the roller shaft 154, thereby allowing rotation of the tilt drive shaft 206 to be transmitted to the roller shaft 154.

Figure 16B:
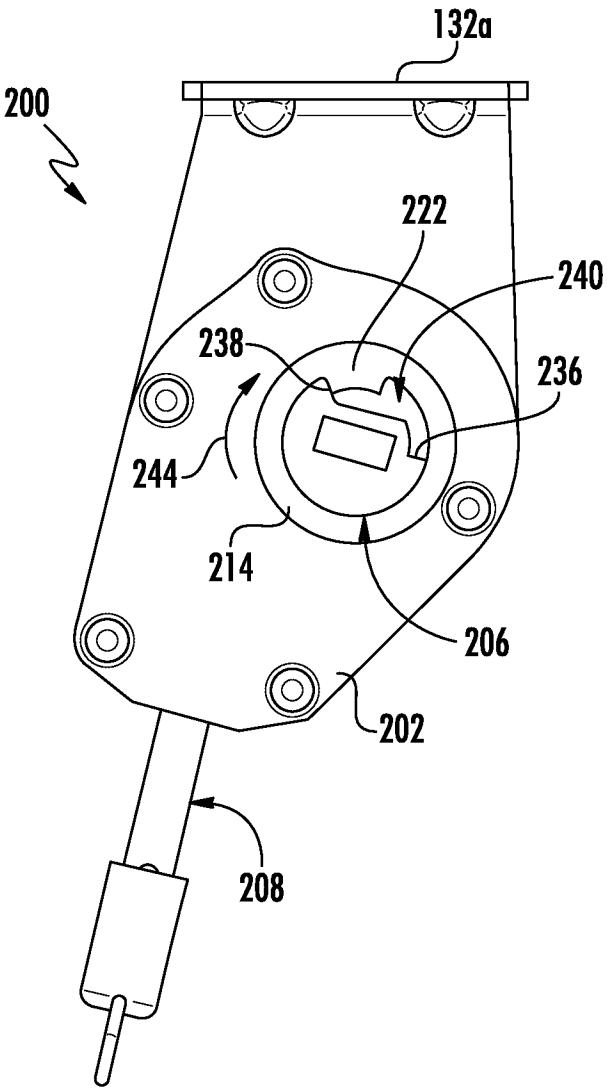
FIGS. 16A and 16B illustrate side views of the tilt adjustment mechanism shown in FIG. 13, particularly illustrating a tilt drive shaft of the tilt adjustment mechanism at opposed ends of its angular range of motion.
Figure 16A:
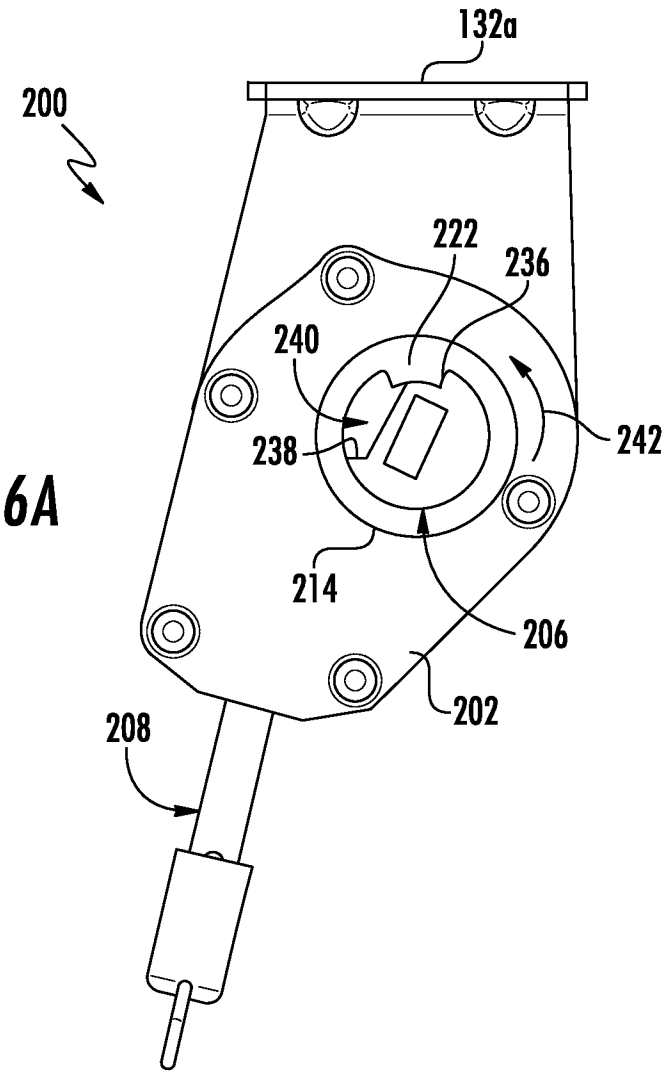

Moreover, the shaft portion 226 of the tilt drive shaft 206 may define a recessed circumferential section 234 adjacent to its end face 232 that extends axially a given distance in the direction of the opposed end of the drive shaft 206. As particularly shown in FIG. 17, the recessed circumferential section 234 may generally extend circumferentially between a first end 236 and a second end 238 such that recessed circumferential section 234 defines a circumferential track 240 between its first and second ends 236, 238. In several embodiments, the angular range of this circumferential track 240 along with the circumferential width of inner rib 222 of the stub shaft 214 may generally define the angular range of motion for the tilt drive shaft 206 relative to stub shaft 214. Specifically, as shown in FIGS. 16A and 16B, when the tilt drive shaft 206 is inserted within the shaft opening 218 of the stub shaft 214, the inner rib 222 may be received within the circumferential track 240 defined by the recessed circumferential section 234 of the shaft portion 226. As such, when the tilt drive shaft 206 is rotated relative to the stub shaft 214, the inner rib 222 may serve as a mechanical stop for the tilt drive shaft 206. Specifically, FIGS. 16A and 16B illustrate the tilt drive shaft 206 positioned at each end of its angular range of motion. For example, as shown in FIG. 16A, by rotating the tilt drive shaft 206 in a first direction (e.g., indicated by arrow 242), the tilt drive shaft 206 may rotate relative to the stub shaft 214 until the first end 236 of the recessed circumferential section 234 contacts the inner rib 222. Similarly, as shown in FIG. 16A, by rotating the tilt drive shaft 206 in the opposite direction (e.g., as indicated by arrow 244), the tilt drive shaft 206 may rotate relative to the stub shaft 214 until the second end 238 of the recessed circumferential section 234 contacts the inner rib 222.

It should be appreciated that the circumferential dimensions of both the track 240 formed by the recessed circumferential section 234 of the tilt drive shaft 206 and the inner rib 222 may be selected such that the tilt drive shaft 206 is allowed to rotate relative to the stub shaft 214 across an angular range of motion sufficient to permit the vanes 120 to be tilted from their fully opened position to their fully closed position. For instance, the angular range of motion for the tilt drive shaft 205 may be less than 270 degrees, such as less than 240 degrees or less than 200 degrees, or less than 150 degrees. Specifically in a particular embodiment, the angular range of motion for the tilt drive shaft 205 may range from about 90 degrees to about 120 degrees, such as from about 100 degrees to about 110 degrees.

Figure 15:
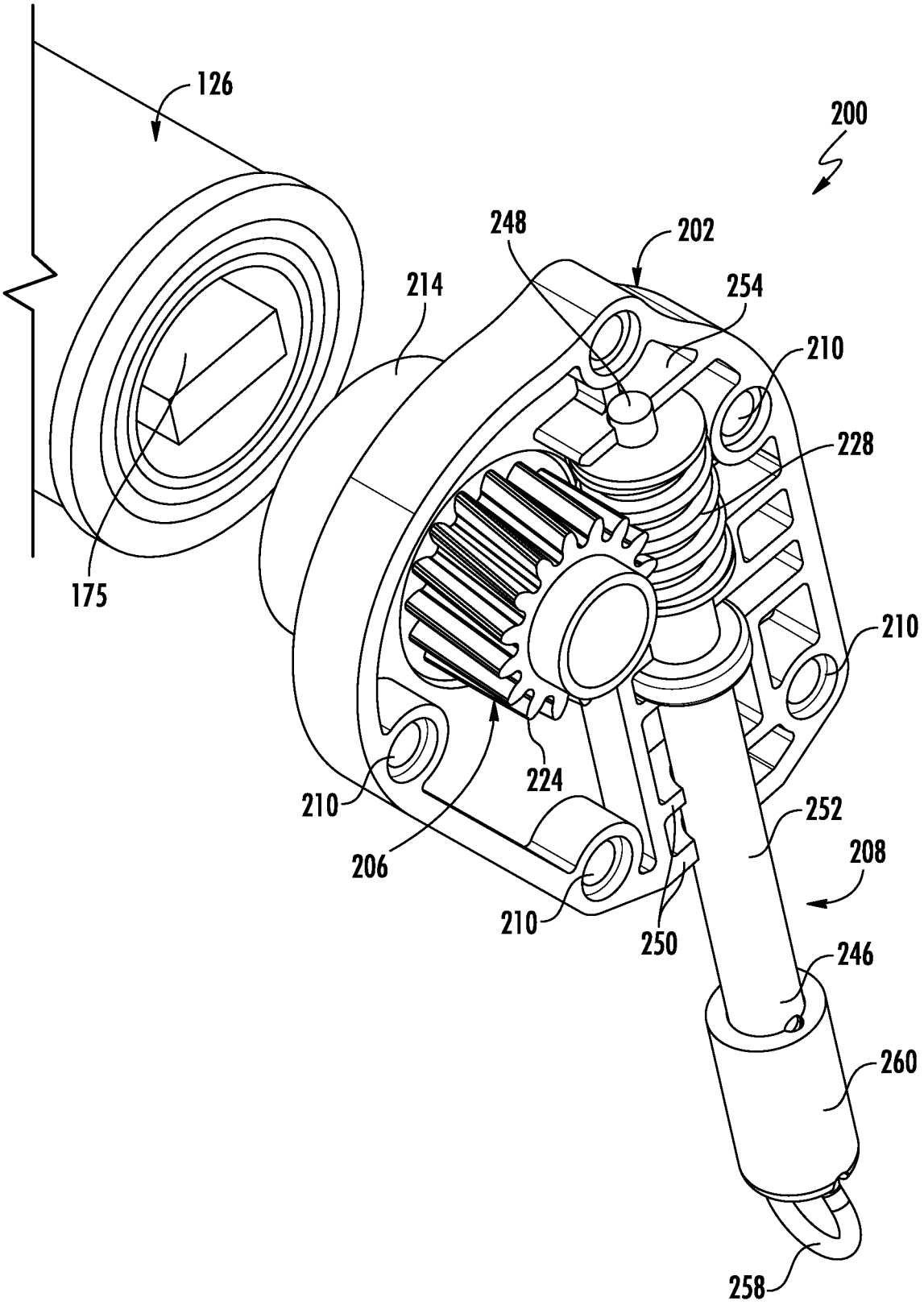
FIG. 15 illustrates partial, perspective view of the tilt adjustment mechanism shown in FIG. 13, particularly illustrating a portion of the housing removed to show various internal components of the tilt adjustment mechanism.

Referring particularly to FIGS. 13-15, the tilt drive actuator 208 of the tilt adjustment mechanism 200 may generally be configured to be positioned within the housing formed by the inner and outer housing members 202, 204 such that a control end 246 of the tilt drive actuator 208 is positioned on the exterior of the housing while a drive end 248 of the actuator 208 is located within the housing. Additionally, the housing members 202, 204 may generally include internal features for rotationally supporting the tilt drive actuator 208 within the interior of the housing. For instance, as shown in FIGS. 14 and 15, the inner and outer housing members 202, 204 may include one or more interior brackets or ribs 250 defining semi-circular shaped grooves for rotationally supporting a circular shaft portion 252 of the tilt drive actuator 208 within the housing. Additionally, as shown in FIGS. 14 and 15, the housing member 202, 204 also include an end rib 254 defining a semi-circular shaped groove for rotational supporting the drive end 248 of the tilt drive actuator 208. The ribs 250, 252 and the corresponding grooves may generally be configured to define bearing surfaces for rotating the tilt drive actuator 208 within the housing relative to the housing members 202, 204.

As shown in the illustrated embodiment, a worm gear 228 may be coupled to or formed integrally with the tilt drive actuator 208 at or adjacent to its drive end 248. As indicated above, the worm gear 228 may be configured to mesh with or otherwise rotationally engage the tilt gear 224 of the tilt drive shaft 206. Thus, when the tilt drive actuator 208 is rotated, the meshed engagement between the worm gear 228 and the tilt gear 224 may allow the rotational motion of the tilt drive actuator 208 to be converted to rotational motion of the tilt drive shaft 206. Such rotational motion of the tilt drive shaft 206 may then be transferred to the roller shaft 154 via the coupling provided between the drive shaft 206 and the transmission end 175 the transmission shaft 173.

Additionally, as shown in FIGS. 13-15, the control end 246 of the tilt drive actuator 208 may be configured to accommodate one or more components for coupling an input control device (e.g., the tilt wand 145 shown in FIG. 1) to the tilt drive actuator 208. For instance, the control end 246 of the tilt drive actuator 208 may define a slot 256 configured to receive a portion of a hooked linkage 258. In such an embodiment, when the hooked linkage 258 is inserted within the slot 256 and a corresponding cap 260 is positioned over the control end 246 of the tilt drive actuator 208, the tilt wand 145 or other suitable user control device may be coupled to the hooked end of the linkage 258 to provide a mechanical connection between the tilt wand 145 and the tilt drive actuator 206. As such, by rotating the tilt wand 145, the tilt drive actuator 208 may be rotationally driven, which may, in turn, transfer rotational motion to the tilt drive shaft 206 via the meshing of the gears 224, 228.

In general, the engagement between the tilt drive actuator 208 and the tilt drive shaft 206 may be configured to perform two functions. First, the engagement between the worm gear 228 and the tilt gear 224 may serve to maintain the roller shaft 154 stationary as the shade panel 102 is being raised and lowered. Specifically, because the worm gear 228 prevents the tilt gear 224 from rotating when the tilt drive actuator 208 is stationary (e.g., when the actuator 208 is not being rotated), the connection provided between the tilt drive actuator 208, the tilt drive shaft 206, and the transmission shaft 173 may hold the roller shaft 154 stationary.

Additionally, the tilt drive actuator 208 and the tilt drive shaft 206 may function to allow the vanes 120 to be tilted between their opened and closed positions. Specifically, when the vanes 120 are in their fully opened position (e.g., as shown in FIG. 3), the tilt drive actuator 208 may be rotated to tilt the vanes 120 towards their closed position. In such instance, the rotational motion of the tilt drive actuator 208 is converted into rotational motion of the tilt drive shaft 206, which, in turn, causes rotation of the transmission shaft 173 and the roller shaft 154. Such rotation of the roller shaft 154 may then cause the roller 126 to rotate in the manner described above with reference to FIGS. 3-5 to adjust the tilt angle of the vanes 120. For instance, in one embodiment, the roller 126 may be rotated across the same angular range of motion as the tilt drive shaft 206 to adjust the tilt angle of the vanes 120 from their fully opened position to their fully closed position.

During operation of the disclosed covering 100, when the shade panel 102 is lowered to its fully extended position, the shade panel 102 is held in such position by the locking engagement of the clutch 152. Thereafter, to adjust the tilt angle of the vanes 120, the tilt drive actuator 208 is rotated in one direction or the other (e.g., via the tilt wand 145) to rotate the tilt drive shaft 206 and, thus, the transmission shaft 173. As the transmission shaft 173 is rotated, the coupling between the transmission shaft 173 and the cam drum 181 causes the drum 181 to rotate in the same direction as the tilt drive shaft 206. Given that the cam drum 181 is rotationally engaged with the roller 126 when the shade panel 102 is at its fully extended position, such rotation of the cam drum 181 results in corresponding rotation of the roller 126. As indicated above, rotation of the roller 126 may result in the front and back panels 112, 114 of the shade panel 102 being moved vertically relative to each other, thereby adjusting the tilt angle of the vanes 120. Thus, by rotating the tilt drive actuator 208 in one direction, the vanes 120 may be tilted to their closed position, at which point the inner rib 222 of the stub shaft 214 may be in contact with one of the ends 236, 238 of the recessed circumferential section 234 of the shaft portion 226 of the tilt drive shaft 206. Similarly, by rotating the tilt drive actuator 208 in the other direction, the vanes 120 may be tilted to their opened position, at which point the inner rib 222 may be in contact with the other end 236, 238 of the recessed circumferential section 234. Additionally, as indicated above, the vanes 120 may also be stopped at any suitable intermediate position defined between the fully opened and fully closed positions. When stopped at such a position, the engagement between the worm gear 228 of the tilt drive actuator 208 and the tilt gear 224 of the tilt drive shaft 206 may serve to hold the vanes 120 at the selected intermediate position.

Moreover, as described above, to retract the shade panel 102 from its fully extended position, the user may simply apply a downward force against the shade panel 102 (e.g., by pulling on the bottom rail 144 or a component coupled to the bottom rail 144) to disengage the cam pin 183 from the stop surface formed within the cam track 182. Thereafter, when the force on the shade panel 102 is released, the cam pin 183 may be allowed to traverse the cam track 182 without stopping rotation of the roller 126. The force provided by the spring motor 150 may then rotate the roller 126 to wind the shade panel 102 around the roller 126. Of course, the movement of the shade panel 102 as it is being retracted may be stopped by the user (e.g., by grasping the bottom rail 144), which allows the cam pin 183 to reengage the cam track 182 at the locked position in order to hold the shade panel 102 at any suitable user-selected intermediate vertical position.

Figure 18:
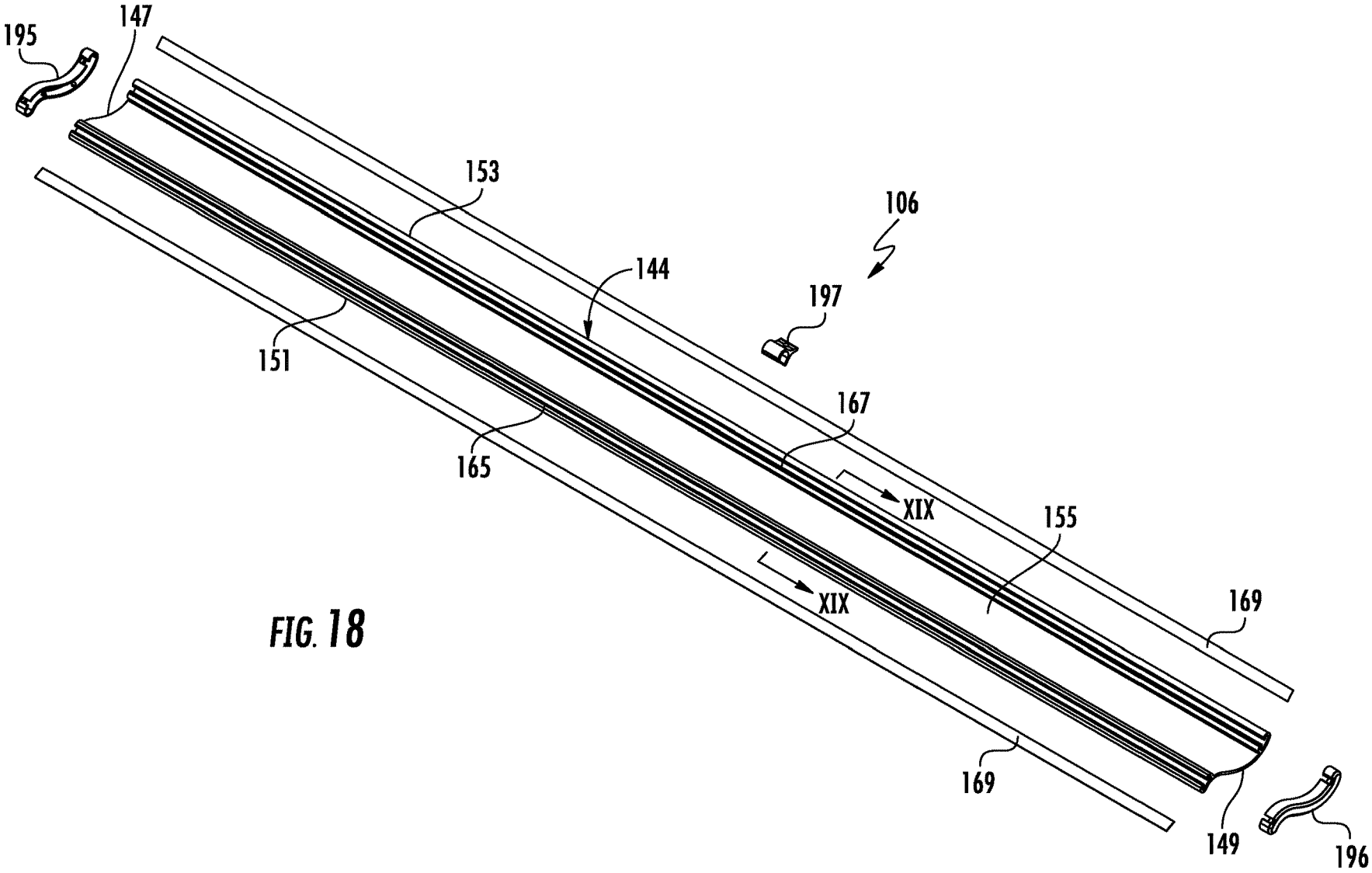
FIG. 18 illustrates a perspective, exploded view of one embodiment of a bottom rail assembly suitable for use within the covering shown in FIG. 1.
Figure 19:
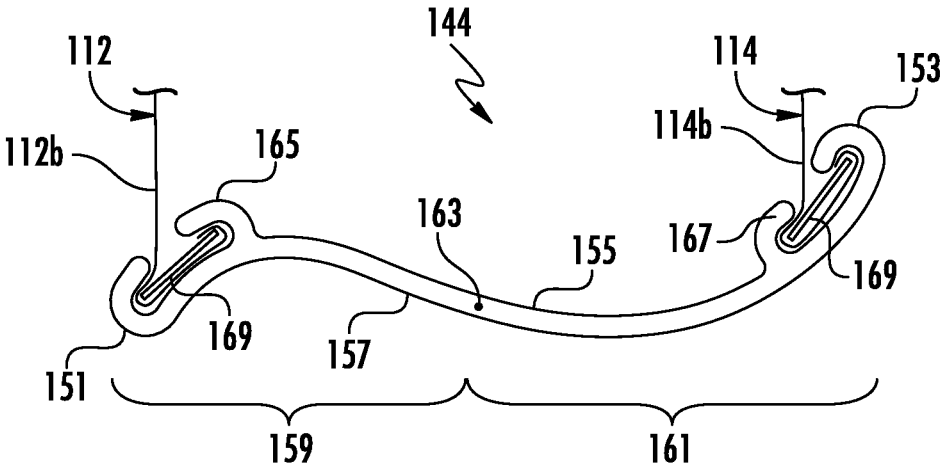
FIG. 19 illustrates a cross-sectional view of a bottom rail of the bottom rail assembly shown in FIG. 18 taken about line XIX-XIX.

Referring now to FIGS. 18 and 19, several views of one embodiment of the bottom rail assembly 106 of the disclosed covering 100 are illustrated in accordance with aspects of the present subject matter. Specifically, FIG. 18 illustrates an exploded, perspective view of the bottom rail assembly 106. Additionally, FIG. 19 illustrates a cross-sectional view of the bottom rail 144 of the bottom rail assembly 106 shown in FIG. 18 taken about line XIX-XIX, with the bottom ends 112*b*, 114*b* of the front and back panels 112, 114 of the shade panel 102 being shown coupled to the bottom rail 144.

As indicated above, the bottom rail assembly 106 may include a bottom rail 144 positioned at the bottom end of the shade panel 102. As shown in FIG. 18, the bottom rail 144 may correspond to an elongated member configured to extend lengthwise along the horizontal width 118 of the shade panel 102 between a first end 147 and a second end 149. Additionally, the bottom rail 144 may be configured to extend in the cross-wise direction 111 (FIG. 3) of the covering 100 between a front side 151 and a back side 153. Moreover, the bottom rail 144 may also define a top side 155 that faces generally vertically upwards (e.g., in the direction of the shade panel 102) and a bottom side 157 that faces generally vertically downwards (e.g., away from the shade panel 102).

In several embodiments, the bottom rail 144 may be configured to define an "S-shaped" profile as it extends in the cross-wise direction 111 between its front and back sides 151, 152. For instance, as particularly shown in FIG. 19, the top side 155 of the bottom rail 144 may define a generally convex profile across a first cross-wise portion 159 of the bottom rail 144 that extends between the front side 151 of the rail 144 and a transition point 163 and a generally concave profile across a second cross-wise portion 161 of the bottom rail 144 that extends from the transition point 163 to the back side 153 of the rail 144. Similarly, the curvature of the bottom side 157 of the rail 144 may generally track the curvature of the top side 155 such that the bottom side 157 defines a generally concave profile across the first cross-wise portion 159 of the bottom rail 144 and a generally convex profile across the second cross-wise portion 161 of the bottom rail 144. This transition between the convex/concave profiles along the top and bottom sides 155, 157 of the bottom rail 144 generally forms the illustrated wavy or "S-shaped" profile along the cross-wise direction 111 of the rail 144. This "S-shaped" profile may be designed, in one embodiment, to generally correspond to the look of the vanes 120 and to continue the flow of the "S-shape" of the vanes 120 through to the bottom rail 144 to provide a seamless, uniform look for the covering 100. Moreover, as will be described in greater detail below, the "S-shaped" profile may also provide one or more functional advantages to the disclosed covering 100, such as by allowing the bottom rail 144 to nest with a portion of the wrapped roller 126 when the shade panel 102 is moved to its fully retracted position.

It should be appreciated that, in general, the bottom rail 144 may be configured to be coupled to the bottom ends 112*b*, 114*b* of the front and back panels 112, 114 using any suitable means known in the art. For example, as shown in the illustrated embodiment, the bottom rail 144 includes front and rear attachment channels 165, 167 extending lengthwise between its first and second ends 147, 149 along the top side 155 of the rail 144, with the front attachment channel 165 being located adjacent to the front side 151 of the bottom rail 144 and the back attachment channel 167 being location adjacent to the back side 153 of the bottom rail 144. In such an embodiment, connector strips 169 may be inserted within the front and rear attachment channels to couple the bottom ends 112*b*, 114*b* of the front and back panels 112, 114 to the bottom rail 144. For instance, the bottom end 112*b*, 114*b* of each panel 112, 114 may be wrapped around or otherwise coupled to its respective connector strip 169. The connector strip 169 may then be slid lengthwise into its corresponding attachment channel 165, 167 to couple the panel to the bottom rail 144. However, in other embodiments, the front and back panels 112, 114 may be coupled to the bottom rail 144 using any other suitable means, such as other fasteners, adhesives, and/or the like. As shown in FIG. 19, when the front and back panels 112, 114, are coupled to the bottom rail 144, each panel may be spaced apart from the adjacent edge or side 151, 153 of the rail 144. Specifically, as shown in the illustrate embodiment, the front panel 112 may be spaced apart from the front edge or side 151 of the bottom rail 144 and the back panel 114 may be spaced apart from the rear edge or side 153 of the bottom rail 144. Such spacing may allow a user of the disclosed covering 100 to grasp the front and back sides 151, 153 of the bottom rail 144 without contacting the panels 112, 114 (or at least with less direct contact with the panels 112, 114), which may be desirable when the panels 112, 114 are formed from a sheer material or other delicate material.

Additionally, as shown in FIG. 18, the bottom rail assembly 106 may also include endcaps 195, 196 configured to be positioned at each horizontal end 147, 149 of the bottom rail 144. Specifically, the bottom rail assembly 106 may include a first endcap 195 configured to be positioned over the first end 147 of the bottom rail 144 and a second end cap 196 configured to be positioned over the second end 149 of the bottom rail 144. Once installed, the endcaps 195, 196 may cover the ends of the attachment channels 165, 167, thereby maintaining the connector strips 169 in position.

Moreover, as shown in FIG. 18, the bottom rail assembly 106 may also include an optional clip 197 configured to be coupled to the back side 153 of the bottom rail 144. The clip 197 may, in one embodiment, be utilized to facilitate the attachment of a handle (not shown) or other suitable user control device to the bottom rail 144. For instance, by coupling a handle to the back side 153 of the bottom rail 144 via the clip 197, the user may grasp the handle to pull the shade panel 102 down in the direction of its fully extended position.

As indicated above, in addition to providing a unique aesthetic appearance, the "S-shaped" cross-wise profile of the bottom rail 144 may also allow a portion of the rail 114 to fit snugly against or otherwise nest with a portion of the wrapped roller 126 when the shade panel 102 is moved to its fully retracted position. For example, FIG. 20 illustrates a cross-sectional view of the covering 100 with the shade panel 102 being completely wound around the roller 126 to its fully retracted position. As shown in FIG. 20, at such position, the concave portion of the top side 155 of the bottom rail 144 may allow a portion of the rail 144 to wrap circumferentially around the exterior of the wrapped roller 126. Thus, while the "S-shaped" cross-wise profile of the bottom rail 144 may be complimentary to the general look of the vanes 120, a portion of the cross-wise profile may also be configured to provide functional advantages for the disclosed covering 100. As such, the cross-wise profile of the bottom rail 144 need not necessarily match the shape of the vanes 120 exactly, particularly when it is desirable to provide the nesting functionality described above.

Figure 21:
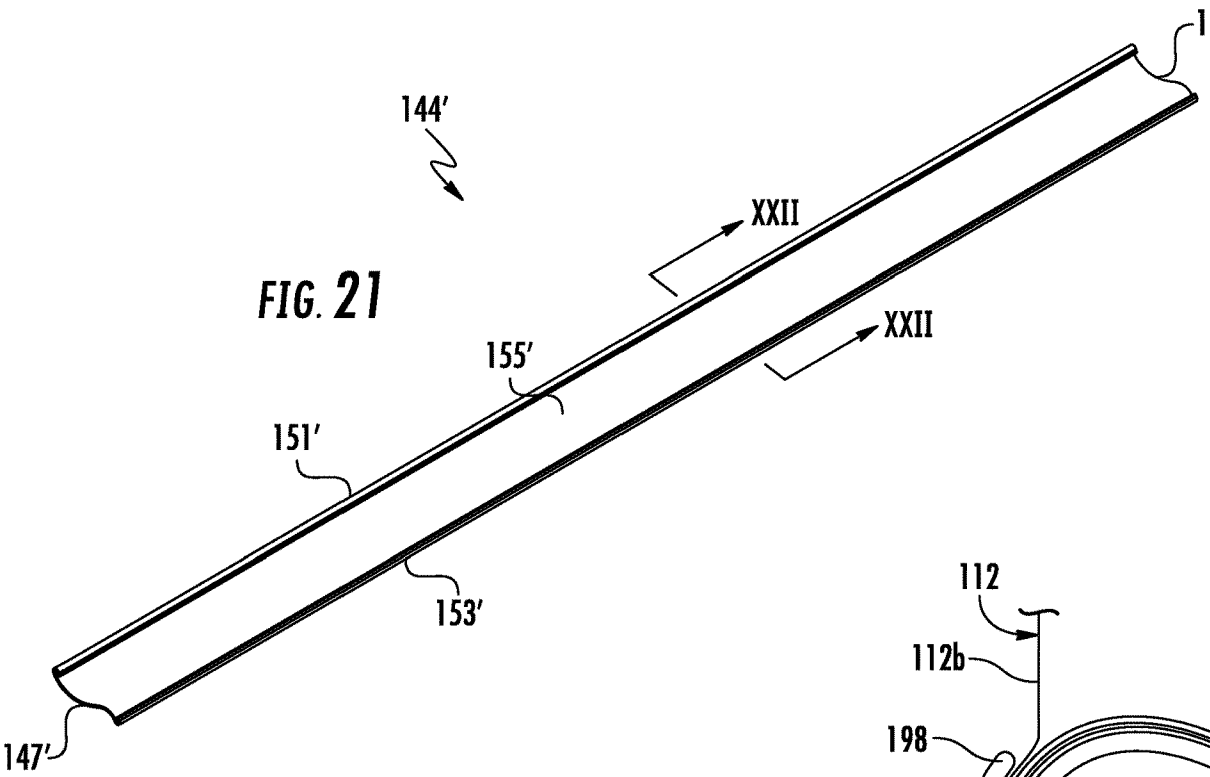
FIG. 21 illustrates a perspective view of another embodiment of a bottom rail suitable for use within the covering shown in FIG. 1.
Figure 22:
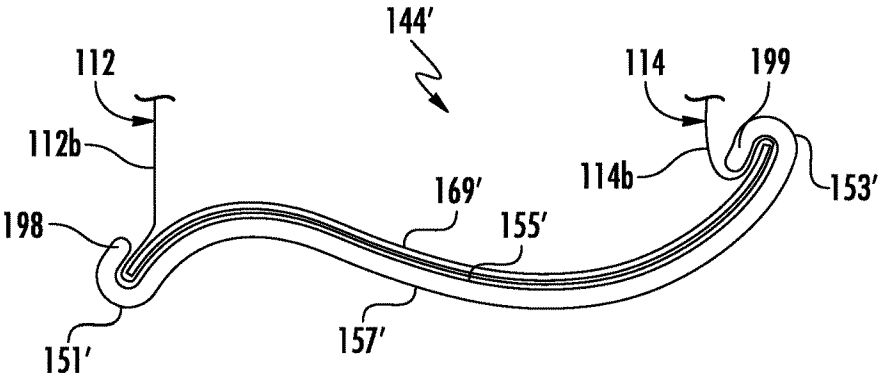
FIG. 22 illustrates a cross-sectional view of the bottom rail shown in FIG. 21 taken about line XXII-XXII.

Referring now to FIGS. 21 and 22, an alternative embodiment of a bottom rail 144' suitable for use with the disclosed covering 100 is illustrated in accordance with aspects of the present subject matter. Specifically, FIG. 21 illustrates a perspective view of the bottom rail 144' and FIG. 22 illustrates a cross-sectional view of the bottom rail 144' taken about line XXII-XXII. Additionally, FIG. 22 also illustrates the front and back panels 112, 114 of the shade panel 102 coupled to the bottom rail 144'.

As shown, the bottom rail 144' is generally configured similar to the bottom rail 144 described above with reference to FIGS. 18-20. For example, the bottom rail 144' may be configured to extend lengthwise along the horizontal width 118 of the shade panel 102 between a first end 147' and a second end 149' and cross-wise along the cross-wise width 122 of the shade panel 102 between a front side 151' and a back side 153'. In addition, the bottom rail 144' may define a top side 155' that faces generally vertically upwards (e.g., in the direction of the shade panel 102) and a bottom side 157' that faces generally vertically downwards (e.g., away from the shade panel 102). Moreover, as particularly shown in FIG. 22, the bottom rail 144' may define an "S-shaped" or wavy profile in the cross-wise direction between its front and back sides 151', 153'.

However, as shown in FIG. 22, unlike the attachment channels 165, 167 described above, the bottom rail 144' includes hooked ends 198, 199 at its front and back sides 151', 153' for coupling the shape panel 102 to the rail 144'. Specifically, the bottom rail 144' includes a front hooked end 198 extending lengthwise along the front side 151' of the rail 144' and a back hooked end 199 extending lengthwise along the back end 153' of the rail 144'. In such an embodiment, a single connector strip 169' may be inserted between the hooked ends 198, 199 along the top side 155' of the rail 144' to facilitate coupling the front and back panels 112, 114 to the bottom rail 144'. For instance, the bottom end 112*b*, 114*b* of each panel 112, 114 may be wrapped around and/or otherwise coupled to the connector strip 169'. The connector strip 169' may then be positioned between the hooked ends 198, 199 of the bottom rail 144' prior to the end caps 195, 196 being installed to complete the assembly.

Figure 23:
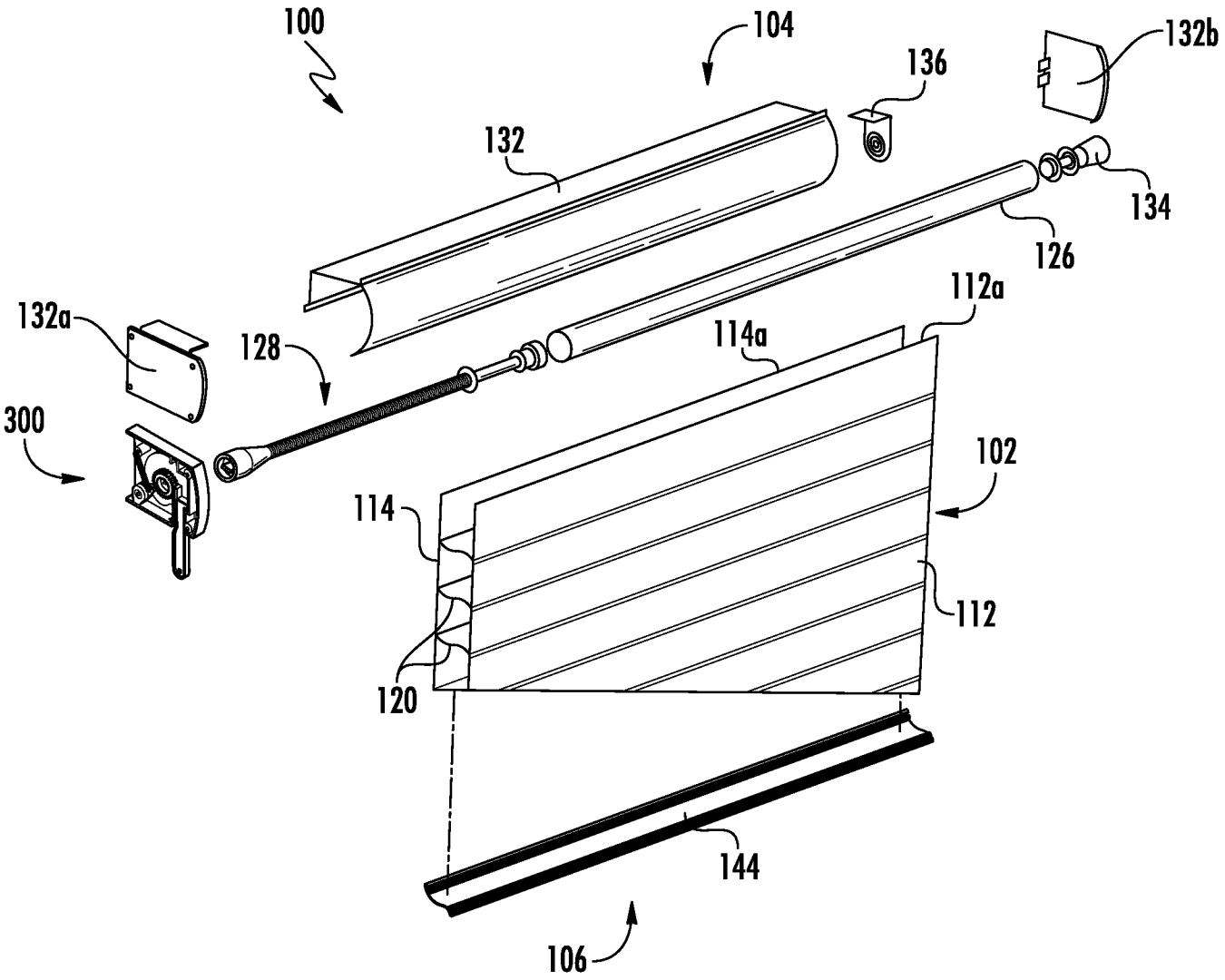
FIG. 23 illustrates a partial, perspective view of another embodiment of a covering, particularly illustrating components of a head rail or roller assembly of the covering exploded out for purposes of illustration and discussion.

Referring now to FIG. 23, another embodiment of the covering 100 described above is illustrated in accordance with aspects of the present subject matter. Specifically, FIG. 23 illustrates a partial, perspective view of the covering 100, with various components of the roller assembly 104 being exploded out for purposes of illustration and discussion. In general, the covering 100 includes all of the same components described above, with components having the same configuration between FIG. 2 and FIG. 23 being identified using the same reference characters. For example, the covering 100 includes a shade panel 102 extending between a head rail or roller assembly 104 and a bottom rail assembly 106, with the shade panel 102 including a front panel 112, a back panel 114 and a plurality of vertically spaced vanes 120 extending between the front and back panels 112, 114. Additionally, the covering 100 includes a roller 126 for winding and unwinding the shade panel 102 and a lift assembly 128 for controlling the movement of the shade panel 102 between its extended and retracted positions. Moreover, as shown in FIG. 23, the covering 100 may also include various other components described above, such as a headrail or cover 132, endcaps, 132*a*, 132*b*, a limiter assembly 134, and a bearing 136.

As shown in FIG. 23, the covering 100 may also include a tilt adjustment mechanism 300 for adjusting the tilt of the vanes 120 when the covering 100 is located at its fully extended position. However, unlike the tilt adjustment mechanism 200 described above, the tilt adjustment mechanism 300 shown in FIG. 23 may be operated by linearly actuating the mechanism 300 using a tilt wand or other suitable user control device. For instance, as will be described below with reference to FIGS. 24-26, the tilt adjustment mechanism 200 may incorporate a rack and pinion assembly that converts linear translation to rotational motion to drive the tilt adjustment mechanism 300 for adjusting the tilt of vanes 120.

Figure 24:
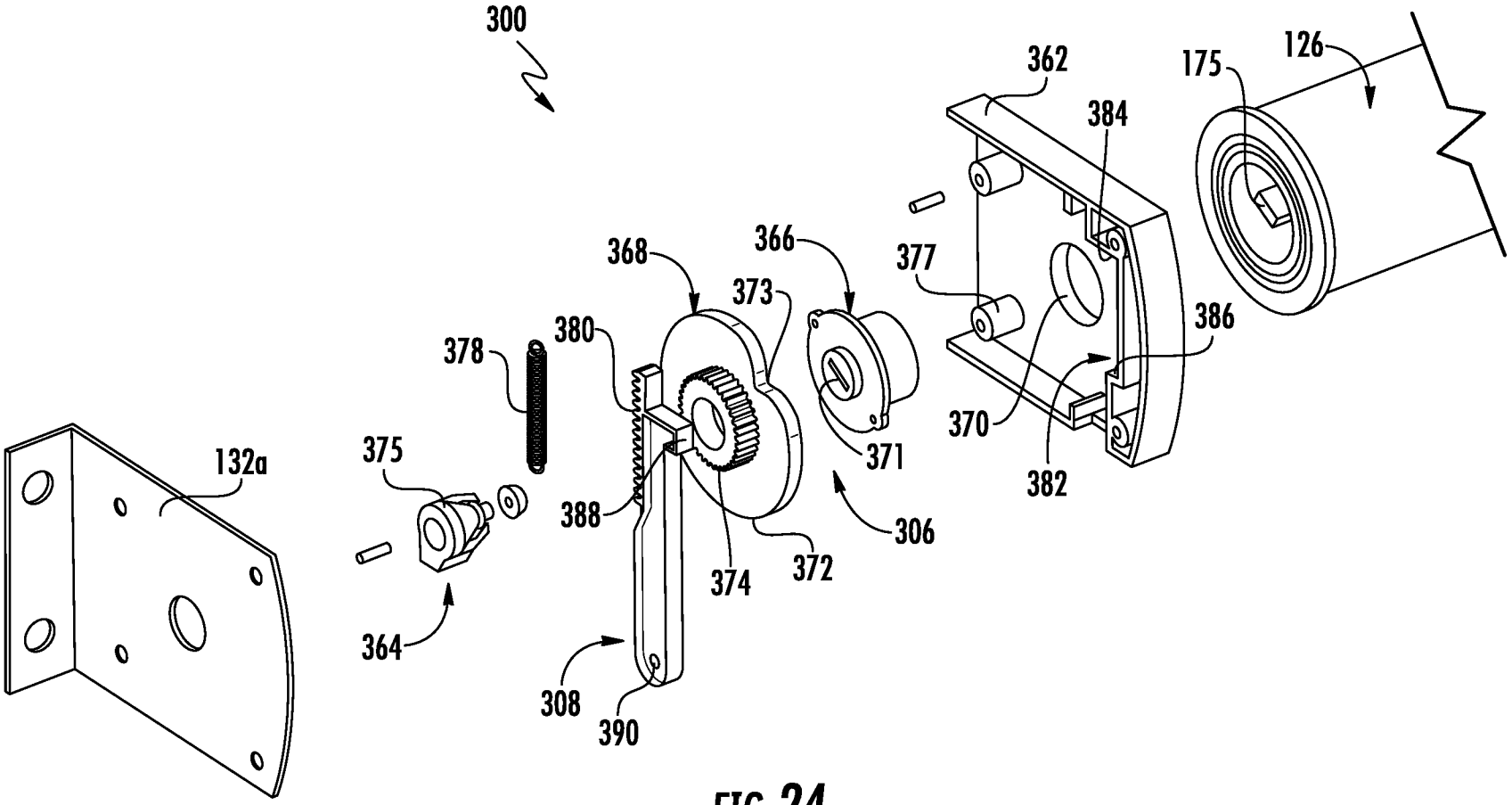
FIG. 24 illustrates a perspective, exploded view of one embodiment of a tilt adjustment mechanism of the covering shown in FIG. 23.
Figure 25:
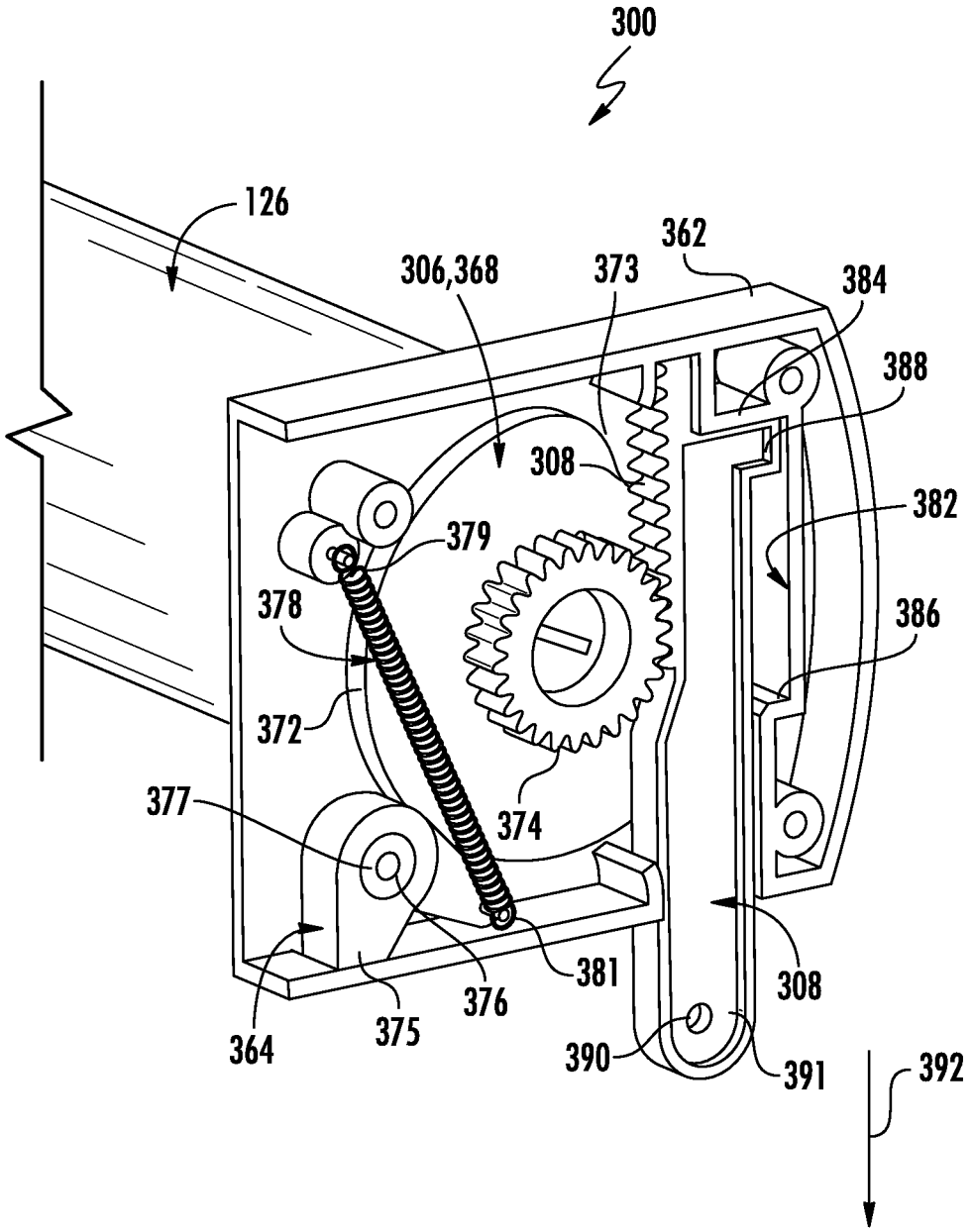
FIG. 25 illustrates a perspective, internal view of the tilt adjustment mechanism shown in FIG. 24.
Figure 26:
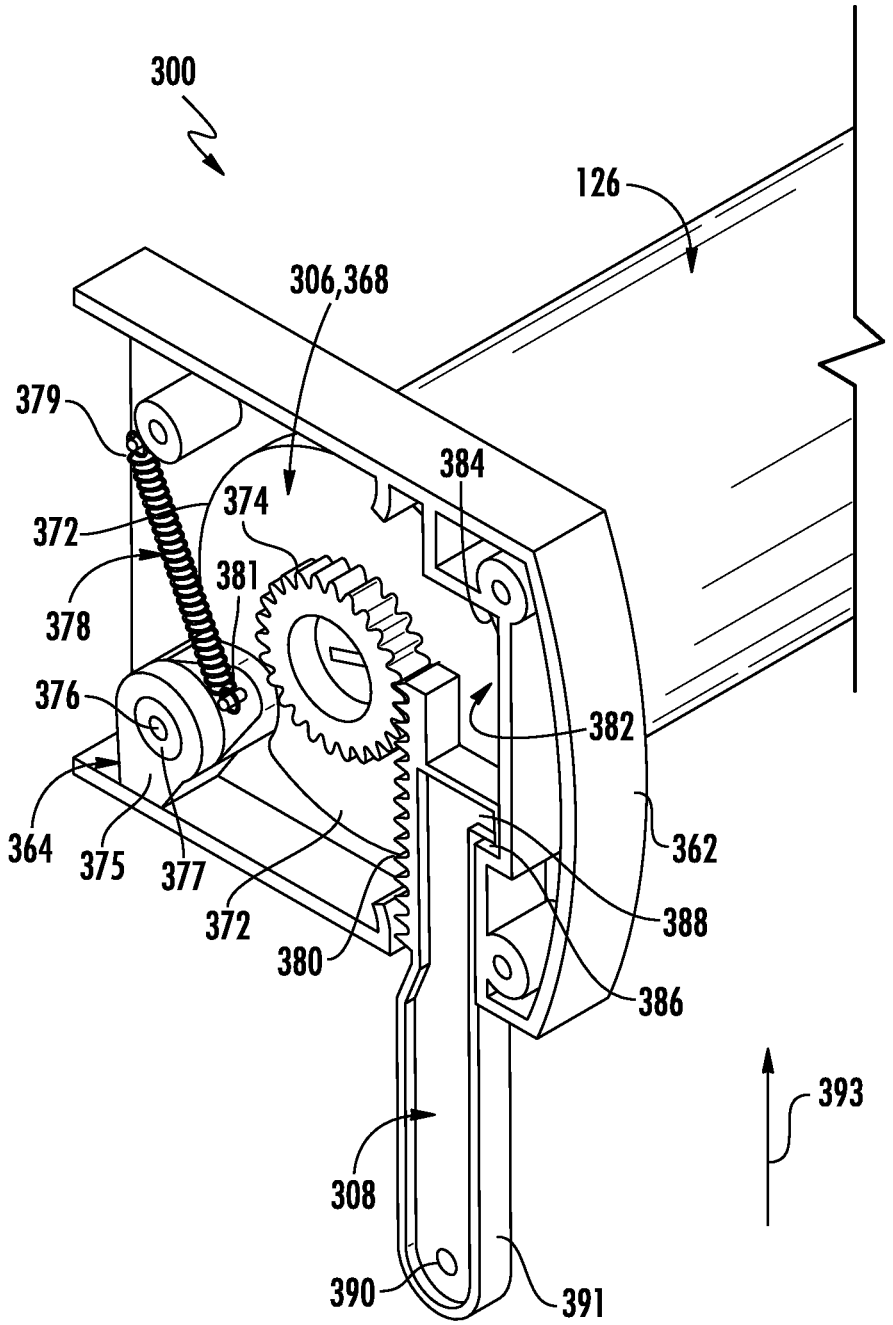
FIG. 26 illustrates another perspective, internal view of the tilt adjustment mechanism shown in FIG. 24.

Referring now to FIGS. 24-26, several views of one embodiment of the tilt adjustment mechanism 300 described above with reference to FIG. 23 are illustrated in accordance with aspects of the present subject matter. Specifically, FIG. 24 illustrates a perspective, exploded view of the tilt adjustment mechanism 300. Additionally, FIGS. 25 and 26 illustrate differing perspective, internal views of the tilt adjustment mechanism 300.

As shown, the tilt adjustment mechanism 300 may include various internal components configured to be at least partially positioned between one of the end caps 132*a* of the roller assembly 104 and a support plate 362 of the tilt adjustment mechanism 300, with the support plate 362 being configured to be coupled to the end cap 132*a*. For example, the tilt adjust mechanism 300 may include a tilt drive shaft 306, a spring-biased locking mechanism 364, and a tilt drive actuator 308.

In general, the tilt drive shaft 306 may include a shaft portion 366 and a control wheel 368 configured to be coupled to the shaft portion 366. The shaft portion 366 may be configured to be supported in a circular aperture 370 defined in the support plate 362 such that the drive shaft 306 may be freely rotated relative to the plate 362. For example, as shown in FIG. 24, the shaft portion 366 may be configured to extend through the aperture 370 such that the inner circumferential surface of the aperture 370 defines a bearing surface for the shaft portion 366. The shaft portion 366 may also be configured to rotationally support the first connector 156 (FIG. 7) of the lift assembly 128 (FIG. 6). For instance, the shaft portion 366 may be configured to be received within the cylindrical bore 174 (FIG. 10) defined by the first connector 156 such that the shaft portion 366 defines a bearing surface for rotation of the connector 156. Additionally, the shaft portion 366 may define an opening 371 configured to receive the portion of the transmission end 175 of the transmission shaft 173 (FIG. 10) extending axially beyond the locking member 177 (FIG. 10) within the roller 126. For example, as shown in FIG. 24, in one embodiment, the opening 371 may be non-round, such as a rectangular-shaped opening, to match the non-round shape of the transmission end 175 of the transmission shaft 173. As such, when the transmission end 175 of the transmission shaft 173 is received within the opening 371, the tilt drive shaft 306 may be coupled to the roller shaft 154 via the transmission shaft 173 such that rotation of the drive shaft 306 results in rotation of the roller shaft 154.

The control wheel 368 of the tilt drive shaft 306 may generally be configured to be fixed to the shaft portion 366 such that the shaft portion 366 and the control wheel 368 rotate together, thereby providing a rotational connection between the control wheel 368 and the roller shaft 154 via the engagement of the transmission shaft 173 with the shaft portion 366. In several embodiments, the control wheel 368 may define a control surface 372 that is formed with a locking detent 373. For example, in the illustrated embodiment, the control surface 372 is defined around the outer periphery of the control wheel 368. However, in other embodiments, the control surface 372 may be defined in any other suitable manner, such as by forming a track on a face of the wheel 368 that defines the control surface. Additionally, the control wheel 368 may also support a pinion gear 374 for rotation therewith. In one embodiment, the pinion gear 374 may be coupled to the control wheel 368 such that both the pinion gear 374 and the control wheel 368 rotate in unison. Alternatively, the pinion gear 374 may be formed integrally with the control wheel 368.

As particularly shown in FIGS. 25 and 26, the spring biased locking mechanism 364 may include a movable lock member 375 configured to engage the control surface 372 of the control wheel 368. In several embodiments, the lock member 375 may be pivotally coupled to the support plate 362 at a pivot point 376. For instance, as shown in FIGS. 24 and 25, the support plate 362 may include a post 377 extending outwardly therefrom that defines a bearing surface for the lock member 375. As such, the lock member 375 may pivot relative to the support plate 362 and the control wheel 368 about the post 377. Additionally, the lock member 375 may be configured to be biased into engagement with the control surface 372 of the control wheel 368 via a spring 378. For instance, as shown FIGS. 25 and 26, the spring 378 may be coupled at one end 379 to a portion of the support plate 362 and at its opposed end 381 to the lock member 375 such that the spring 378 provides a biasing force that biases the lock member 375 into engagement with the control surface 372 (e.g., by applying a biasing force configured to bring the opposed ends 379, 381 of the spring 378 towards each other).

Additionally, as indicated above, the tilt adjustment mechanism 300 may also include a tilt drive actuator 308 having a geared rack 380 configured to engage the pinion gear 374 of the tilt drive shaft 306, thereby providing a rack and pinion-type assembly. In several embodiments, the actuator 308 may be configured to be linearly translated relative to the pinion gear 374 across a predetermined range of travel. Specifically, as shown in FIG. 25, in one embodiment, the support plate 362 may define a channel 382 extending lengthwise between a top end 384 and a bottom end 386, with the range of travel being defined between the ends 384, 386 of the channel 382. In such an embodiment, the actuator 308 may include an outwardly extending flange 388 configured to be received within the channel 382 so that the flange 388 is moved between the top and bottom ends 384, 386 of the channel 382 as the actuator 308 is linearly translated across its range of travel. Thus, the ends 384, 386 of the channel 382 may be configured to serve as mechanical stops for the actuator 308. Additionally, as shown in FIGS.

25 and 26, a portion 391 of the actuator 308 may be configured to extend outwardly from between the support plate 362 and endcap 132*a* to allow the actuator 308 to be accessed by a user of the covering 100. For instance, a user may directly grasp the portion 391 of the actuator 308 extending outwardly to operate the tilt adjustment mechanism 300. Alternatively, a user control device, such as a tilt wand (not shown), may be coupled to the actuator 300 (e.g., by coupling the control device to the actuator via opening 390) to facilitate operation of the tilt adjustment mechanism 300.

In general, the engagement between the rack 380 and the pinion 374 may be configured to perform two functions. First, the rack 380 and pinion 374 may serve to maintain the roller shaft 154 (FIG. 6) stationary as the shade panel 102 is being raised and lowered. Specifically, because the rack 380 prevents the pinion 374 from rotating when the rack 380 is stationary, the connection provided between the tilt drive shaft 306 and the transmission shaft 173 (FIG. 10) may hold the roller shaft 154 stationary. The roller 126 (FIG. 2) may then be allowed to rotate relative to the roller shaft 154 via operation of the clutch assembly 152 (FIG. 10) to raise or lower the shade panel 102 (FIG. 1).

Additionally, the rack 380 and pinion 274 may function to allow the vanes 120 to be tilted between their opened and closed positions. Specifically, when the vanes 120 are in their fully opened position (e.g., as shown in FIG. 3), the actuator 308 may be moved relative to the pinion gear 274 (e.g., in the downward direction indicated by arrow 392 in FIG. 25) to tilt the vanes 120 towards their closed position. In such instance, the linear translation of the rack 380 is converted into rotational motion of the pinion 373 and, thus, rotation of the tilt drive shaft 306. Rotation of the tilt drive shaft 306, in turn, causes rotation of the transmission shaft 173 and the roller shaft 154. Such rotation of the roller shaft 154 may then cause the roller 126 to rotate in the manner described above with references to FIGS. 3-5 to adjust the tilt angle of the vanes 120. For instance, the roller 126 may be rotated less than 360 degrees (e.g., approximately 180 degrees or approximately 90 degrees, depending on the configuration) to adjust the tilt angle of the vanes 120 from their fully opened position to their fully closed position It should be appreciated that the tilt drive shaft 306 may be rotated until the detent 373 defined on the control wheel 368 is aligned with the lock member 375. In such instance, the spring 378 may bias the lock member 375 into engagement with the detent 373 to hold the tilt drive shaft 306 in position. The force applied by the locking member 375 on the control wheel 368 may be overcome by linearly translating the actuator 308 (e.g., in the direction of arrow 393 shown in FIG. 26). Thus, the lock member 375 may serve to hold the control wheel 368 in a fixed position until a force is applied through the rack and pinion assembly via the actuator 308.

During operation of the disclosed covering 100, when the shade panel 102 is lowered to its fully extended position, the shade panel 102 is held in such position by the locking engagement of the clutch mechanism 152. Thereafter, to adjust the tilt angle of the vanes 120, the tilt drive actuator 308 is moved linearly relative to the pinion gear 374 to rotate the tilt drive shaft 306 and, thus, the transmission shaft 173 in the closing direction (e.g., as shown by arrow 146 in FIG. 3). As the transmission shaft 173 rotates, the cam drum 181 (FIG. 10) is caused to rotate in the same direction as the tilt drive shaft 306. Given that the cam drum 181 is rotationally engaged with the roller 126 when the shade panel 102 is at its fully extended position, such rotation of the cam drum 181 results in corresponding rotation of the roller 126. As indicated above, rotation of the roller 126 may result in the front and back panels 112, 114 of the shade panel 102 being moved vertically relative to each other, thereby adjusting the tilt angle of the vanes 120. Thus, by manipulating the tilt drive actuator 308 in a manner that causes the tilt drive shaft 306 to rotate in the closing direction 146, the vanes 120 may be tilted to their closed position, at which point the detent 373 defined on the control wheel 368 may be aligned with the lock member 375 such that the lock member 375 engages the detent 373 and resists the tendency of the shade panel 102 to move the vanes 120 to the opened position due to the force of gravity acting on the panel 102. Similarly, to move the vanes 120 from the closed position to the opened position, the tilt drive actuator 308 may be linearly actuated in the opposite direction to cause the tilt drive shaft 306 to rotate in the opening direction. The force applied by the tilt drive actuator 308 may overcome the locking force between the locking member 375 and the control wheel 368 to allow the tilt drive shaft 306 to be rotated.

Additionally, as indicated above, the vanes 120 may also be stopped at any suitable intermediate tilt position defined between the fully opened and fully closed positions. When stopped at such a position, the friction within the system may, in one embodiment, be sufficient to hold the vanes 120 at the desired intermediate tilt position. However, in other embodiments, it may be desirable to include additional detents at predetermined locations along the control surface 372 of the control wheel 368 to establish intermediate stopping points around the circumference of the control wheel 368 at which the lock member 375 may engage the control wheel 368 to provide an additional braking force within the tilt adjustment mechanism 300.

According to an aspect of the present subject matter, a covering for an architectural structure may include a roller and a shade panel configured to be wound around and unwound from the roller to move the shade panel between an extended position and a retracted position. The shade panel may include a front panel, a back panel, and a plurality of vanes extending between the front and back panels. The covering may also include a roller shaft extending through the roller and a tilt adjustment mechanism coupled to the roller shaft. The tilt adjustment mechanism may be configured to rotate the roller shaft to adjust a tilt angle of the plurality of vanes. Additionally, the roller may be configured to rotate relative to the roller shaft when the shade panel is being moved between the extended and retracted positions. Moreover, the roller may be configured to rotate with the roller shaft when the tilt adjustment mechanism is used to adjust the tilt angle of the plurality of vanes.

In some embodiments, the tilt adjustment mechanism may include a tilt drive shaft coupled to the roller shaft and a tilt drive actuator rotatably coupled to the tilt drive shaft.

In some embodiments, a transmission shaft may be coupled to or formed integrally with the roller shaft such that the roller shaft rotates with rotation of the transmission shaft.

In some embodiments, the tilt drive shaft may be coupled to a transmission end of the transmission shaft such that the tilt drive shaft is rotatably coupled to the transmission shaft.

In some embodiments, the tilt drive shaft may include a gear configured to mesh with a corresponding component of the tilt drive actuator.

In some embodiments, the tilt drive actuator may include a gear rack configured to mesh with the gear of the tilt drive shaft such that linear actuation of the tilt drive actuator results in rotation of the tilt drive shaft.

In some embodiments, the tilt drive actuator includes a worm gear configured to mesh with the gear of the tilt drive shaft such that rotation of the tilt drive actuator results in rotation of the tilt drive shaft.

In some embodiments, the tilt adjustment mechanism includes a fixed stub shaft defining an axial shaft opening and the tilt drive shaft includes a shaft portion configured to be received within the axial shaft opening such that the shaft portion is rotatable relative to the stub shaft.

In some embodiments, the stub shaft may include an inner rib extending radially inwardly relative to an inner circumferential surface of the stub shaft and the shaft portion may define a circumferential track configured to receive the inner rib of the stub shaft when the shaft portion is inserted within the axial shaft opening.

In some embodiments, the circumferential track may define an angular range of motion for the tilt drive shaft relative to the stub shaft.

In some embodiments, the tilt drive shaft may be rotated relative to the stub shaft such that the inner rib contacts a first end of the circumferential track, the plurality of vanes are located at a fully opened position. Additionally, when the tilt drive shaft is rotated relative to the stub shaft such that the inner rib contacts a second end of the circumferential track, the plurality of vanes are located at a fully closed position.

In some embodiments, the tilt drive shaft may include a control wheel defining a detent and the tilt adjustment mechanism may include a locking member configured to engage the detent defined by the control wheel when the tilt drive shaft is rotated in a manner that aligns the detent with the locking member.

In some embodiments, the locking member may be spring-biased into engagement with an outer surface of the control wheel.

In some embodiments, a clutch may be operatively coupled between the roller and the roller shaft. The clutch may be movable between a locked position, at which the roller is configured to rotate with the roller shaft, and an unlocked position, at which the roller is configured to rotate relative to the roller shaft.

In some embodiments, tilt adjustment mechanism is configured to rotate the roller shaft to adjust the tilt angle of the plurality of vanes when the clutch is at the locked position such that rotation of the roller shaft results in rotation of the roller.

In some embodiments, the clutch may include a cam drum and a locking member. The cam drum may be configured to be spaced axially apart from the locking member when the clutch is at the unlocked position. Additionally, the cam drum may be configured to be engaged with the locking member when the clutch is at the locked position.

In some embodiments, the cam drum may define a track configured to receive a cam pin and traversal of the cam pin across the track may result in the cam drum being moved axially towards and axially away from the locking member.

In some embodiments, a bottom rail may be coupled to bottom ends of the front and back panels. The bottom rail may define a cross-wise profile along a cross-wise direction of the covering that is configured to at least partially nest with a portion of the roller when the shade panel is moved to the retraced position.

In some embodiments, a lift assembly may be operatively coupled to the roller. The lift assembly may include a spring motor configured to raise the shade panel towards the retracted position.

In some embodiments, the spring motor may include a spring mounted on the roller shaft that extends between a first end and a second end. One of the first end or the second end of the spring may be coupled to the roller shaft for rotation therewith and the other of the first end or the second end of the spring may be configured to rotate with the roller relative to the roller shaft.

According to another aspect of the present subject matter, a covering for an architectural structure may include a roller and a shade panel configured to be wound around and unwound from the roller to move the shade panel between an extended position and a retracted position. The shade panel may include a front panel, a back panel, and a plurality of vanes extending between the front and back panels. The covering may also include a roller shaft extending through the roller and a tilt adjustment mechanism coupled to the roller shaft. The tilt adjustment mechanism may include a tilt drive shaft coupled to the roller shaft and a tilt drive actuator rotationally coupled to the tilt drive shaft. The tilt drive shaft may be configured to rotate the roller shaft to adjust a tilt angle of the plurality of vanes upon actuation of the tilt drive actuator by a user of the covering.

In some embodiments, the roller may be configured to rotate relative to the roller shaft when the shade panel is being moved between the extended and retracted positions. The roller may also be configured to rotate with the roller shaft when the tilt adjustment mechanism is used to adjust the tilt angle of the plurality of vanes.

In some embodiments, a transmission shaft may be coupled to or formed integrally with the roller shaft such that the roller shaft rotates with rotation of the transmission shaft.

In some embodiments, the tilt drive shaft may be coupled to a transmission end of the transmission shaft such that the tilt drive shaft is rotatably coupled to the transmission shaft.

In some embodiments, the tilt drive shaft may include a gear configured to mesh with a corresponding component of the tilt drive actuator.

In some embodiments, the tilt drive actuator may include a gear rack configured to mesh with the gear of the tilt drive shaft such that linear actuation of the tilt drive actuator results in rotation of the tilt drive shaft.

In some embodiments, the tilt drive actuator includes a worm gear configured to mesh with the gear of the tilt drive shaft such that rotation of the tilt drive actuator results in rotation of the tilt drive shaft.

In some embodiments, the tilt adjustment mechanism includes a fixed stub shaft defining an axial shaft opening and the tilt drive shaft includes a shaft portion configured to be received within the axial shaft opening such that the shaft portion is rotatable relative to the stub shaft.

In some embodiments, the stub shaft may include an inner rib extending radially inwardly relative to an inner circumferential surface of the stub shaft and the shaft portion may define a circumferential track configured to receive the inner rib of the stub shaft when the shaft portion is inserted within the axial shaft opening.

In some embodiments, the circumferential track may define an angular range of motion for the tilt drive shaft relative to the stub shaft.

In some embodiments, the tilt drive shaft may be rotated relative to the stub shaft such that the inner rib contacts a first end of the circumferential track, the plurality of vanes are located at a fully opened position. Additionally, when the tilt drive shaft is rotated relative to the stub shaft such that the inner rib contacts a second end of the circumferential track, the plurality of vanes are located at a fully closed position.

In some embodiments, the tilt drive shaft may include a control wheel defining a detent and the tilt adjustment mechanism may include a locking member configured to engage the detent defined by the control wheel when the tilt drive shaft is rotated in a manner that aligns the detent with the locking member.

In some embodiments, the locking member may be spring-biased into engagement with an outer surface of the control wheel.

In some embodiments, a clutch may be operatively coupled between the roller and the roller shaft. The clutch may be movable between a locked position, at which the roller is configured to rotate with the roller shaft, and an unlocked position, at which the roller is configured to rotate relative to the roller shaft.

In some embodiments, tilt adjustment mechanism is configured to rotate the roller shaft to adjust the tilt angle of the plurality of vanes when the clutch is at the locked position such that rotation of the roller shaft results in rotation of the roller.

According to a further aspect of the present subject matter, a covering for an architectural structure may include a roller and a shade panel configured to be wound around and unwound from the roller to move the shade panel between an extended position and a retracted position. The shade panel may include a front panel, a back panel, and a plurality of vanes extending between the front and back panels. The covering may also include a tilt adjustment mechanism configured to be selectively coupled to the roller. The tilt adjustment mechanism may be configured to rotate the roller to adjust a tilt angle of the plurality of vanes. Additionally, the tilt adjustment mechanism may be decoupled from the roller when the shade panel is being moved between the extended and retracted positions.

In some embodiments, a clutch may be operatively coupled between the roller and the tilt adjustment mechanism. The clutch may be movable between a locked position, at which the roller is configured to be rotated by the tilt adjustment mechanism, and an unlocked position, at which the roller is not configured to be rotated by the tilt adjustment mechanism.

According to yet another aspect of the present subject matter, a covering for an architectural structure may include a roller and a shade panel configured to be wound around and unwound from the roller to move the shade panel between an extended position and a retracted position. The shade panel may include a front panel, a back panel, and a plurality of vanes extending between the front and back panels. The covering may also include a bottom rail coupled to bottom ends of the front and back panels, the bottom rail defining a curved cross-wise profile. When the shade panel is moved to the retracted position, at least a portion of the curved cross-wise profile of the bottom rail is configured to nest with a portion of the roller.

In some embodiments, the bottom rail may extend in a cross-wise direction between a front side and a rear side. The front and back panels may be coupled to the bottom rail so as to be spaced apart from the front side and back sides of the bottom rail in the cross-wise direction.

In some embodiments, a top side of the bottom rail may define a convex profile across a first cross-wise portion of the bottom rail and a concave profile across a second cross-wise portion of the bottom rail. At least a portion of the second cross-wise portion of the bottom rail may be configured to extend circumferentially around the portion of the roller.

While the foregoing Detailed Description and drawings represent various embodiments, it will be understood that various additions, modifications, and substitutions may be made therein without departing from the spirit and scope of the present subject matter. Each example is provided by way of explanation without intent to limit the broad concepts of the present subject matter. In particular, it will be clear to those skilled in the art that principles of the present disclosure may be embodied in other forms, structures, arrangements, proportions, and with other elements, materials, and components, without departing from the spirit or essential characteristics thereof. For instance, features illustrated or described as part of one embodiment can be used with another embodiment to yield a still further embodiment. Thus, it is intended that the present subject matter covers such modifications and variations as come within the scope of the appended claims and their equivalents. One skilled in the art will appreciate that the disclosure may be used with many modifications of structure, arrangement, proportions, materials, and components and otherwise, used in the practice of the disclosure, which are particularly adapted to specific environments and operative requirements without departing from the principles of the present subject matter. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the present subject matter being indicated by the appended claims, and not limited to the foregoing description.

In the foregoing Detailed Description, it will be appreciated that the phrases "at least one", "one or more", and "and/or", as used herein, are open-ended expressions that are both conjunctive and disjunctive in operation. The term "a" or "an" element, as used herein, refers to one or more of that element. As such, the terms "a" (or "an"), "one or more" and "at least one" can be used interchangeably herein. All directional references (e.g., proximal, distal, upper, lower, upward, downward, left, right, lateral, longitudinal, front, rear, top, bottom, above, below, vertical, horizontal, cross-wise, radial, axial, clockwise, counterclockwise, and/or the like) are only used for identification purposes to aid the reader's understanding of the present subject matter, and/or serve to distinguish regions of the associated elements from one another, and do not limit the associated element, particularly as to the position, orientation, or use of the present subject matter. Connection references (e.g., attached, coupled, connected, joined, secured, mounted and/or the like) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

All apparatuses and methods disclosed herein are examples of apparatuses and/or methods implemented in accordance with one or more principles of the present subject matter. These examples are not the only way to implement these principles but are merely examples. Thus, references to elements or structures or features in the drawings must be appreciated as references to examples of embodiments of the present subject matter, and should not be understood as limiting the disclosure to the specific elements, structures, or features illustrated. Other examples of manners of implementing the disclosed principles will occur to a person of ordinary skill in the art upon reading this disclosure.

This written description uses examples to disclose the present subject matter, including the best mode, and also to enable any person skilled in the art to practice the present subject matter, including making and using any devices or systems and performing any incorporated methods. The patentable scope of the present subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A covering for an architectural structure, the covering comprising:

a roller;

a shade panel assembly configured to be wound around and unwound from the roller to move the shade panel assembly between an extended position and a retracted position, the shade panel assembly including a front panel, a back panel, and a plurality of vanes extending between the front and back panels;

a roller shaft extending through the roller; and a tilt adjustment mechanism coupled to the roller shaft, the tilt adjustment mechanism being configured to rotate the roller shaft to adjust a tilt angle of the plurality of vanes;

wherein:

the roller is configured to rotate relative to the roller shaft when the shade panel assembly is being moved between the extended and retracted positions; and the roller is configured to rotate with the roller shaft when the tilt adjustment mechanism is used to adjust the tilt angle of the plurality of vanes.

2. The covering of claim 1, wherein the tilt adjustment mechanism comprises a tilt drive shaft coupled to the roller shaft and a tilt drive actuator rotatably coupled to the tilt drive shaft.

3. The covering of claim 2, further comprising a transmission shaft coupled to or formed integrally with the roller shaft such that the roller shaft rotates with rotation of the transmission shaft.

4. The covering of claim 3, wherein the tilt drive shaft is coupled to a transmission end of the transmission shaft such that the tilt drive shaft is rotatably coupled to the transmission shaft.

5. The covering of claim 2, wherein the tilt drive shaft comprises a gear configured to mesh with a corresponding component of the tilt drive actuator.

6. The covering of claim 5, wherein the tilt drive actuator includes a gear rack configured to mesh with the gear of the tilt drive shaft such that linear actuation of the tilt drive actuator results in rotation of the tilt drive shaft.

7. The covering of claim 5, wherein the tilt drive actuator includes a worm gear configured to mesh with the gear of the tilt drive shaft such that rotation of the tilt drive actuator results in rotation of the tilt drive shaft.

8. The covering of claim 2, wherein:

the tilt adjustment mechanism comprises a fixed stub shaft defining an axial shaft opening; and the tilt drive shaft comprises a shaft portion configured to be received within the axial shaft opening such that the shaft portion is rotatable relative to the stub shaft.

9. The covering of claim 8, wherein:

the stub shaft includes an inner rib extending radially inwardly relative to an inner circumferential surface of the stub shaft; and the shaft portion defines a circumferential track configured to receive the inner rib of the stub shaft when the shaft portion is inserted within the axial shaft opening.

10. The covering of claim 9, wherein the circumferential track defines an angular range of motion for the tilt drive shaft relative to the stub shaft.

11. The covering of claim 9, wherein:

when the tilt drive shaft is rotated relative to the stub shaft such that the inner rib contacts a first end of the circumferential track, the plurality of vanes are located at a fully opened position; and when the tilt drive shaft is rotated relative to the stub shaft such that the inner rib contacts a second end of the circumferential track, the plurality of vanes are located at a fully closed position.

12. The covering of claim 2, wherein:

the tilt drive shaft comprises a control wheel defining a detent; and the tilt adjustment mechanism further comprises a locking member configured to engage the detent defined by the control wheel when the tilt drive shaft is rotated in a manner that aligns the detent with the locking member.

13. The covering of claim 12, wherein the locking member is spring-biased into engagement with an outer surface of the control wheel.

14. The covering of claim 1, further comprising a clutch operatively coupled between the roller and the roller shaft;

wherein the clutch is movable between a locked position, at which the roller is configured to rotate with the roller shaft, and an unlocked position, at which the roller is configured to rotate relative to the roller shaft.

15. The covering of claim 1, further comprising a bottom rail coupled to bottom ends of the front and back panels;

wherein the bottom rail defines a cross-wise profile along a cross-wise direction of the covering that is configured to at least partially nest with a portion of the roller when the shade panel assembly is moved to the retraced position.

16. The covering of claim 1, further comprising a bottom rail coupled to bottom ends of the front and back panels;

wherein the bottom rail defines a curved cross-wise profile that corresponds to a cross-wise profile of each of the plurality of vanes.

17. The covering of claim 1, wherein the shade panel assembly is transitioned cordlessly between the extended and retracted positions.

18. A covering for an architectural structure, the covering comprising:

a roller;

a shade panel assembly configured to be wound around and unwound from the roller to move the shade panel assembly between an extended position and a retracted position, the shade panel assembly including a front panel, a back panel, and a plurality of vanes extending between the front and back panels;

a roller shaft extending through the roller; and a tilt adjustment mechanism coupled to the roller shaft, the tilt adjustment mechanism including a tilt drive shaft coupled to the roller shaft and a tilt drive actuator rotationally coupled to the tilt drive shaft, the tilt drive shaft being configured to rotate the roller shaft to adjust a tilt angle of the plurality of vanes upon actuation of the tilt drive actuator by a user of the covering.

19. A covering for an architectural structure, the covering comprising:

a roller;

a shade panel assembly configured to be wound around and unwound from the roller to move the shade panel assembly between an extended position and a retracted position, the shade panel assembly including a front panel, a back panel, and a plurality of vanes extending between the front and back panels;

a tilt adjustment mechanism configured to be selectively coupled to the roller, the tilt adjustment mechanism being configured to rotate the roller to adjust a tilt angle of the plurality of vanes;

wherein the tilt adjustment mechanism is decoupled from the roller when the shade panel assembly is being moved between the extended and retracted positions.

20. The covering of claim 19, further comprising: a clutch operatively coupled between the roller and the tilt adjustment mechanism;

wherein the clutch is movable between a locked position, at which the roller is configured to be rotated by the tilt adjustment mechanism, and an unlocked position, at which the roller is not configured to be rotated by the tilt adjustment mechanism.

* * * * *